US011192702B2

(12) United States Patent
Merzeau et al.

(10) Patent No.: US 11,192,702 B2
(45) Date of Patent: Dec. 7, 2021

(54) CARTON AND CARTON BLANK

(71) Applicant: WestRock Packaging Systems, LLC, Atlanta, GA (US)

(72) Inventors: Julien D. Merzeau, Châteauroux (FR); Patrick Blin, Châteauroux (FR)

(73) Assignee: WestRock Packaging Systems, LLC, Atlanta, GA (US)

( * ) Notice: Subject to any disclaimer, the term of this patent is extended or adjusted under 35 U.S.C. 154(b) by 224 days.

(21) Appl. No.: 16/332,726

(22) PCT Filed: Sep. 13, 2017

(86) PCT No.: PCT/US2017/051261
§ 371 (c)(1),
(2) Date: Mar. 12, 2019

(87) PCT Pub. No.: WO2018/052929
PCT Pub. Date: Mar. 22, 2018

(65) Prior Publication Data

US 2019/0256267 A1 Aug. 22, 2019

Related U.S. Application Data

(60) Provisional application No. 62/393,852, filed on Sep. 13, 2016.

(51) Int. Cl.

| | |
|---|---|
| ***B65D 71/36*** | (2006.01) |
| ***B65D 5/02*** | (2006.01) |
| ***B65D 25/28*** | (2006.01) |

(52) U.S. Cl.
CPC ..... *B65D 71/36* (2013.01); *B65D 5/0209* (2013.01); *B65D 5/0227* (2013.01);
(Continued)

(58) Field of Classification Search
CPC .... B65D 71/36; B65D 5/0209; B65D 5/0227; B65D 25/2888; B65D 2571/00141; B65D 2571/00462; B65D 2571/00524; B65D 2571/00543; B65D 2571/00574; B65D 2571/0066; B65D 2571/00728;
(Continued)

(56) References Cited

U.S. PATENT DOCUMENTS

| | | | |
|---|---|---|---|
| 2,062,539 | A | 5/1934 | Vogt |
| 2,751,075 | A | 7/1951 | Arenson |

(Continued)

FOREIGN PATENT DOCUMENTS

| | | | |
|---|---|---|---|
| CN | 102514794 | A | 6/2012 |
| FR | 2196630 | A5 | 3/1974 |

(Continued)

*Primary Examiner* — Shawn M Braden
*Assistant Examiner* — Brijesh V. Patel
(74) *Attorney, Agent, or Firm* — Brian J. Goldberg; Neil G. Cohen

(57) ABSTRACT

A carton (102) for packaging one or more articles (B) includes a plurality of walls including atop wall (142), a bottom wall (132), at least two vertical walls (112, 114) and a curved corner (113) between the vertical walls. An internal buttress structure (156) adjacent the top wall provides a curved support edge located apart from the top wall and providing a support edge for the curved corner. A handle strap (266) may be provided in the top wall.

20 Claims, 21 Drawing Sheets

(52) U.S. Cl.
CPC .. *B65D 25/2888* (2013.01); *B65D 2571/0066* (2013.01); *B65D 2571/0087* (2013.01); *B65D 2571/00141* (2013.01); *B65D 2571/00308* (2013.01); *B65D 2571/00462* (2013.01); *B65D 2571/00524* (2013.01); *B65D 2571/00543* (2013.01); *B65D 2571/00574* (2013.01); *B65D 2571/00728* (2013.01); *B65D 2571/00839* (2013.01)

(58) Field of Classification Search
CPC .. B65D 2571/00839; B65D 2571/0087; B65D 2571/00
USPC ..... 206/145, 459.1, 140, 459.5, 147, 429, 206/427, 433, 152–153; 229/182.1, 103.2
See application file for complete search history.

(56) References Cited

U.S. PATENT DOCUMENTS 2,586,301 A * 2/1952 Castle ..... B65D 5/18 206/193
3,807,624 A 4/1974 Funkhouser
4,015,769 A 4/1977 Erlich
4,143,805 A 3/1979 Sutton
4,919,266 A * 4/1990 McIntosh, Jr. ..... B65D 71/14 206/427
5,197,656 A 3/1993 Hoell et al.
5,249,681 A 10/1993 Miller
5,395,043 A * 3/1995 Bacques ..... B65D 71/36 206/427
5,472,090 A * 12/1995 Sutherland ..... B65D 71/36 206/427
5,480,091 A * 1/1996 Stout ..... B65D 5/46072 229/117.13
5,551,556 A * 9/1996 Sutherland ..... B65D 71/32 206/147
5,813,540 A * 9/1998 Vollbrecht ..... B65D 5/2019 206/427
5,944,253 A * 8/1999 Miller ..... B65D 71/36 229/182.1
6,152,359 A 11/2000 Clark
6,202,920 B1 * 3/2001 Auclair ..... B65D 5/18 229/103.2
D473,136 S 4/2003 McLeish
D489,609 S 5/2004 Holthaus et al.
D522,376 S 6/2006 Hales
7,318,523 B2 1/2008 Spatafora
8,225,985 B2 7/2012 Oliverira
8,777,093 B2 7/2014 Smith
8,905,263 B2 12/2014 Becherer et al.
8,955,736 B2 * 2/2015 Spivey, Sr. ..... B65D 5/46192 229/117.12
8,997,987 B1 4/2015 Block
9,809,348 B2 * 11/2017 Smalley ..... B65D 5/4266
2005/0199692 A1 * 9/2005 Nelson ..... B65D 5/3621 229/182.1
2011/0000799 A1 * 1/2011 Gonzalez ..... B65D 71/42 206/147
2011/0226845 A1 * 9/2011 DePaula ..... B65D 71/42 229/103.2
2011/0284403 A1 11/2011 Hendryx et al.
2011/0287146 A1 11/2011 Stowe et al.
2011/0287149 A1 11/2011 Robert et al.
2012/0273379 A1 11/2012 Loftin
2013/0008940 A1 * 1/2013 Schumaker ..... B65D 71/36 229/198.2
2014/0021082 A1 * 1/2014 Holley, Jr. ..... B65D 5/445 206/427
2014/0332427 A1 11/2014 Holley
2016/0114933 A1 4/2016 Smalley
2016/0122072 A1 * 5/2016 Smalley ..... B65D 5/0227 229/116.1
2016/0122075 A1 * 5/2016 Spartis ..... B65D 71/285 229/117.23
2016/0340096 A1 * 11/2016 Smalley ..... B65D 71/36
2017/0101240 A1 * 4/2017 Boersma ..... B65D 71/36
2018/0009585 A1 * 1/2018 Ramsuer ..... B65D 71/36

FOREIGN PATENT DOCUMENTS

WO WO9621603 A1 7/1996
WO WO2012138267 A1 10/2012

* cited by examiner

H
266
242
Y
250
258a
258b
217
252
254
214
266
273
272
278
276
262
273
279
218
277
242
249
275
273
217
(258b)
(259)
216
212
213
214
216
302
239

CARTON AND CARTON BLANK

TECHNICAL FIELD

The present invention relates to a carton and to a blank for forming the carton more specifically, but not exclusively, to a carton having one or more curved corners, and a carrying handle for carrying the carton.

BACKGROUND

In the field of packaging it is often required to provide consumers with a package holding multiple primary product containers. Such multi-packs are desirable for shipping and distribution and for display of promotional information. For cost and environmental considerations, such cartons or carriers need to be formed from as little material as possible and cause as little wastage in the materials from which they are formed as possible. Another consideration is the strength of the packaging and its suitability for holding and transporting large weights of articles.

It is desirable to provide a carton with a carrying handle for transportation by a consumer. It is desirable that the carrying handle allows the carton to be stacked, and can be deployed so as to be readily accessed by the consumer.

Furthermore it is often desirable to have the carton closely wrap the multiple primary product containers within the carton. This may permit the most economical use of material, and may prevent the primary product containers from moving in the carton which could damage some containers such as beverage bottles, which may clash against one another, potentially marring graphics printed on the container or on its product label. In some situations glass bottles clashing against one another may be broken. It would therefore be advantageous to have a carton that minimizes movement of the primary product containers.

The present invention seeks to overcome or at least mitigate the problems of the prior art.

SUMMARY

According to a first aspect of the present invention there is provided a carton with at least one curved corner. The curved corner may closely conform to the surface of at least one primary product container within the carton. The curved corner may be a rounded corner (e.g. shaped as a portion of a circle) and may have a radius that closely matches a major radius of the primary product container, such as its main or lower diameter.

According to a second aspect of the present invention, the carton may contain an internal buttress or keel to help support a curved corner in an area where the primary product container has a radius less than its major radius, such as the neck of a beverage bottle. Besides supporting the curved corner, the internal buttress may support the neck of the beverage bottle and may provide a buttress structure to cooperate with machine equipment for gluing shut the carton.

A handle structure may be provided for the carton. The handle structure may include a handle strap struck from a panel forming a carton wall and a handle strap disposed below the panel. The handle structure may include a handle reinforcing panel hingedly connected to the handle strap by a fold line.

Within the scope of this application it is envisaged and intended that the various aspects, embodiments, examples, features and alternatives set out in the preceding paragraphs, in the claims and/or in the following description and drawings may be taken independently or in any combination thereof. For example, features described in connection with one embodiment are applicable to all embodiments unless there is incompatibility of features.

BRIEF DESCRIPTION OF THE DRAWINGS

Exemplary embodiments of the invention will now be described with reference to the accompanying drawings, in which.

DETAILED DESCRIPTION OF EMBODIMENTS

Detailed descriptions of specific embodiments of the blanks and cartons are disclosed herein. It will be understood that the disclosed embodiments are merely examples of the way in which certain aspects of the invention can be implemented and do not represent an exhaustive list of all of the ways the invention may be embodied. As used herein, the word "exemplary" is used expansively to refer to embodiments that serve as illustrations, specimens, models, or patterns. Indeed, it will be understood that the blanks and cartons described herein may be embodied in various and alternative forms. The Figures are not necessarily to scale and some features may be exaggerated or minimised to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Figure 1:
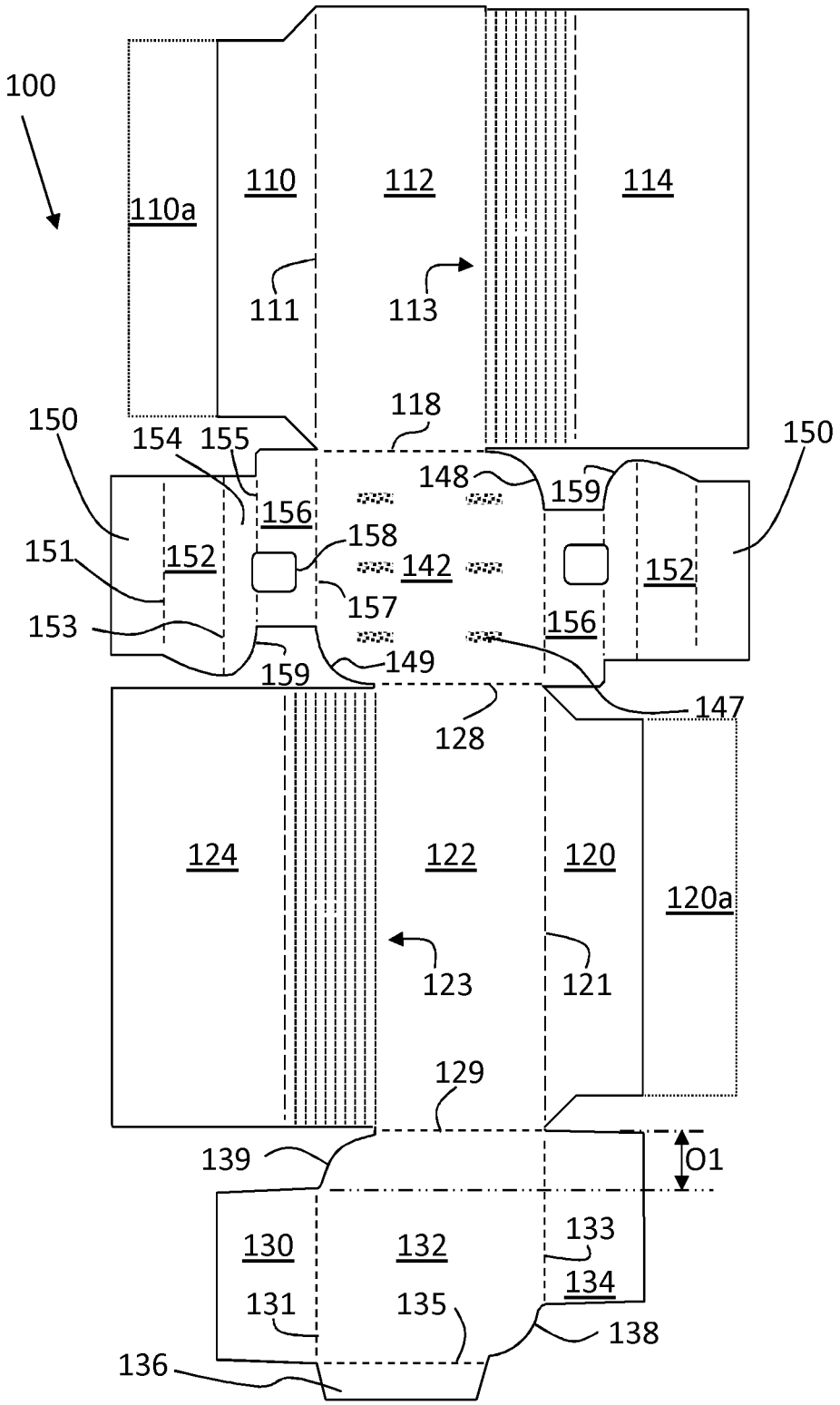
FIG. 1 is a plan view from above of a blank for forming a carton according to a first embodiment.
Figure 4:
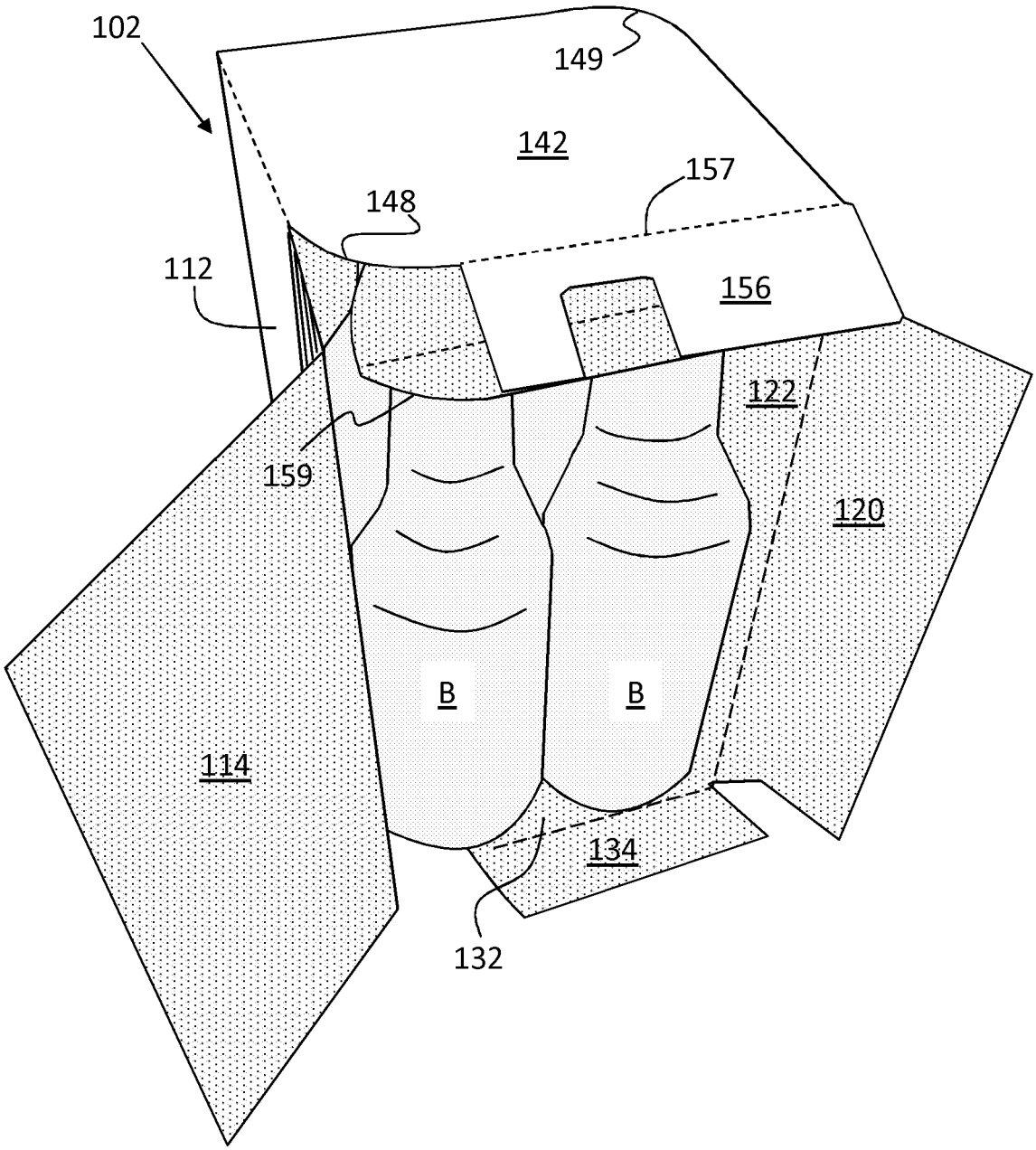
FIG. 4 is a perspective view from an end of a carton formed from the blank of FIG. 3, during loading with primary product containers.

Referring to FIG. 1, there is shown a plan view of a blank 100 capable of forming a carton 102 as shown in FIG. 4, for primary products such as, but not limited to, bottles, cans or any other substantially cylindrical articles, hereinafter referred to as articles B. In particular the carton is well adapted to contain bottles B having a neck that is narrower than the main portion of the bottle.

In the embodiments detailed herein, the term "carton" refers, for the non-limiting purpose of illustrating the various features of the invention, to a container for engaging, carrying, and/or dispensing articles, such as product containers B. It is contemplated that the teachings of the invention can be applied to various product containers B, which may or may not be tapered and/or cylindrical. Exemplary containers include bottles (for example metallic, glass or plastics bottles), cans (for example aluminium cans), tins, pouches, packets and the like.

The blanks 100, 200, 300, 400 are formed from a sheet of suitable substrate. It is to be understood that, as used herein, the term "suitable substrate" includes all manner of foldable sheet material such as paperboard, corrugated board, cardboard, plastic, combinations thereof, and the like. It should be recognized that one or other numbers of blanks may be employed, where suitable, for example, to provide the carrier structure described in more detail below.

In the exemplary embodiments, the blanks 100, 200, 300, 400 are configured to form a carton or carrier for packaging an exemplary arrangement of articles. In a first illustrated exemplary embodiment shown in FIGS. 1-6, the arrangement is a 2×2 matrix or array and the articles are bottles. In the second and third illustrated exemplary embodiments shown in FIGS. 7-24, the arrangement is a 2×5 matrix or array and the articles are bottles. Alternatively, the blanks 100, 200, 300, 400 can be configured to form a carton for packaging other types, numbers and sizes of article and/or for packaging articles in a different arrangement or configuration.

As shown in FIG. 1, a blank 100 includes a plurality of main panels 112, 142, 122, 132 hinged one to the next in a linear series. The blank 100 includes a first side panel 112 hinged to a top panel 142 by a fold line 118. The top panel 142 is hinged to a second side panel 122 by a fold line 128. The second side panel 122 is hinged to a bottom panel 132 by a fold line 129. The bottom panel 132 is hinged to a glue flap 136 by a fold line 135.

The bottom panel 132 and top panel 142 need not be exact rectangles. In particular, each of the bottom and top panels may have at least one curved corner. In the examples herein, the top and bottom panel typically have two diagonally opposed curved corners, and two diagonally opposed 'square' corners meeting at an angle (here 90 degrees). With diagonally opposed curved corners, bottom end panels 130, 134 that extend from bottom panel 132 may be longitudinally offset from one another along the blank as denoted by "O1" in FIG. 1. In a similar manner, buttress outer panels 156, 156 extending from top panel 142 may diagonally opposed from one another across the top panel 142, and may be longitudinally offset from one another along the blank.

As explained later with regard to FIG. 24, there may be more or fewer than two curved corners on each of the bottom and top panels. When there are two curved corners on each of the bottom and top panels, the curved corners may be diagonally opposed, or may be adjacent to each other along one side or one end of the carton.

The plurality of main panels 112, 142, 122, 132 of the blank 100 form the walls of an open ended tubular structure (see FIG. 4) in a set up condition.

Each of the ends of the tubular structure is at least partially closed by end panels, which form end walls of the tubular structure. In the illustrated embodiment (starting from the top of FIG. 1, running down the left side), a first end of the tubular structure is closed by a first side end panel 110 (hingedly connected to first side panel 112 through fold line 111), buttress outer panel 156 of a first buttress structure (hingedly connected to top panel 142 through fold line 157), a second side end panel 124 (hingedly connected to second side panel 122 through a curved panel 123), and bottom end panel 130 (hingedly connected to bottom panel 132 through fold line 131).

In a similar manner, a second end of the tubular structure is closed by a first side end panel 114 (hingedly connected to first side panel 112 through a curved panel 113), buttress outer panel 156 of a second buttress structure (hingedly connected to top panel 142 through fold line 157), a second side end panel 120 (hingedly connected to second side panel 122 through fold line 121), and bottom end panel 134 (hingedly connected to bottom panel 132 through fold line 133).

The curved panels 113, 123 may be provided with a plurality of vertical score lines to facilitate forming a smoothly curved panel when the carton is finished. However, the score lines are optional and the curved panels can be formed without the use of score lines, as illustrated later with blanks 200, 300, and 400. The width of the side end panels 110, 120 may be made somewhat greater (e.g. panels 110*a*, 120*a*) if desired, and the width of the side end panels 114, 124 (which panels 110, 120 overlap) made somewhat less if desired.

The first and second buttress structures each include a buttress outer panel 156 hingedly connected to top panel 142 through fold line 157, a buttress floor panel 154 hingedly connected to buttress outer panel 156 through fold line 155, a buttress inner panel 152 hingedly connected to buttress floor panel 154 through fold line 153, and buttress glue panel 150 hingedly connected to buttress inner panel 152 through fold line 151. In buttress outer panel 156 there may be provided an aperture 158 whose purpose will be described later.

As seen in FIG. 1, each of the buttress structures is attached to top panel 142 through a fold line 157. A curved edge 159 on the buttress structure is joined through buttress outer panel 156 to a curved corner 149 on the top panel. The shapes of curved edge 159 and curved corner 149 may at least partially be mirror images and may have the same radius. At least one of curved corners 149 on top panel 142 may be aligned with a curved panel 113, 123 extending from an adjacent side panel 112, 122. Here, two curved corners 148, 149 on top panel 142 are aligned with curved panels 113, 123 extending from adjacent side panels and also are aligned with curved corners 138, 139 on bottom panel 132. The same alignment is maintained in the finished carton 102 shown on FIG. 6.

For initial setup into a flat tubular structure, glue or adhesive may be provided for example at points 147 on the inside surface of top panel 142. Then as shown in FIG. 2, the buttress structures may be folded inward along fold lines 155 (according to arrows 155F) thereby forming flattened buttress tubes.

Figure 2:
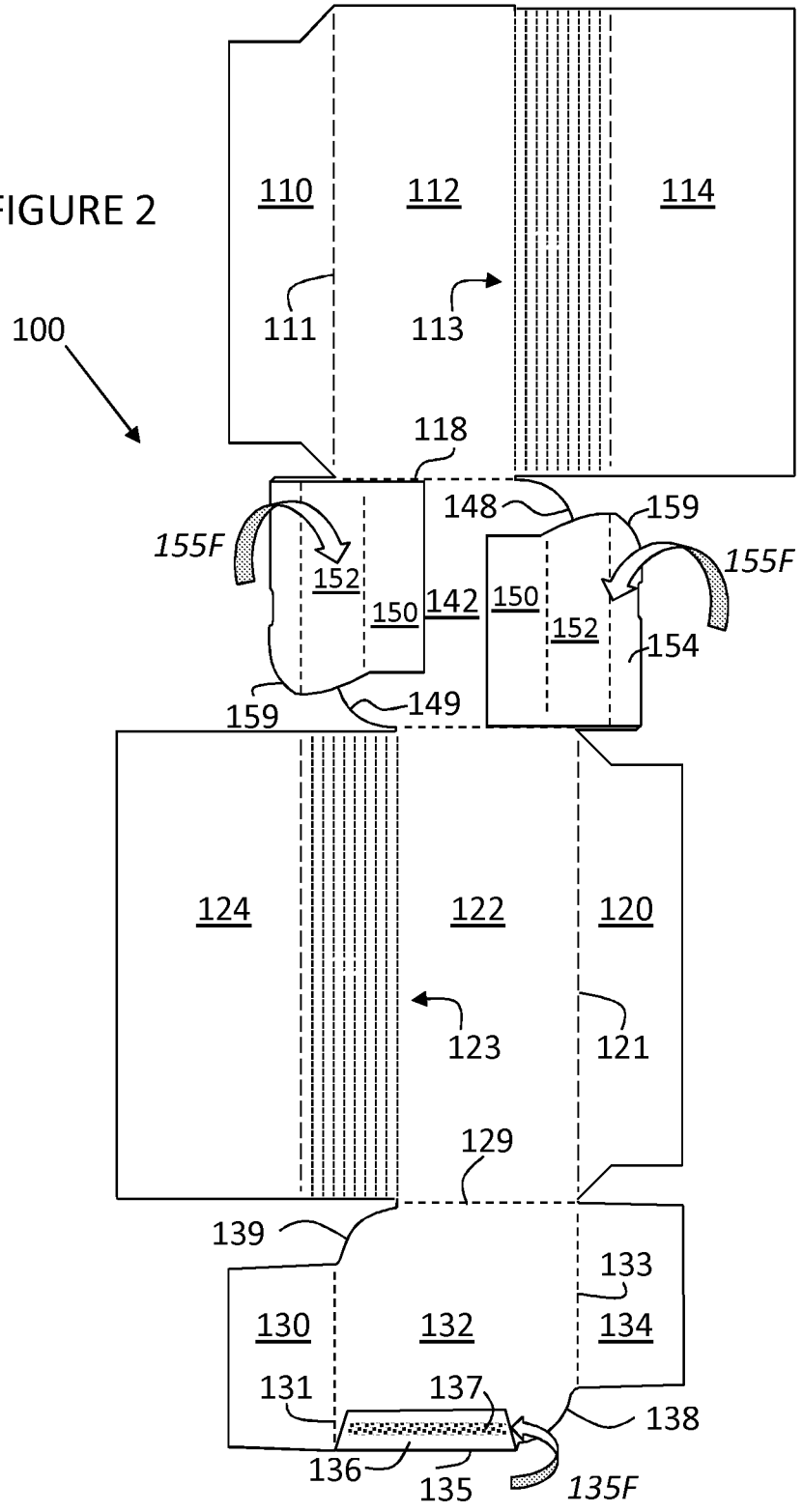
FIG. 2 is a plan view from above of the blank of FIG. 1 after certain portions are folded.

As also shown in FIG. 2, glue flap 136 may be folded inward along fold line 135 (according to arrow 135F) onto the inside of bottom panel 132. Glue 137 may then be applied to the exposed surface of glue flap 136.

Figure 3:
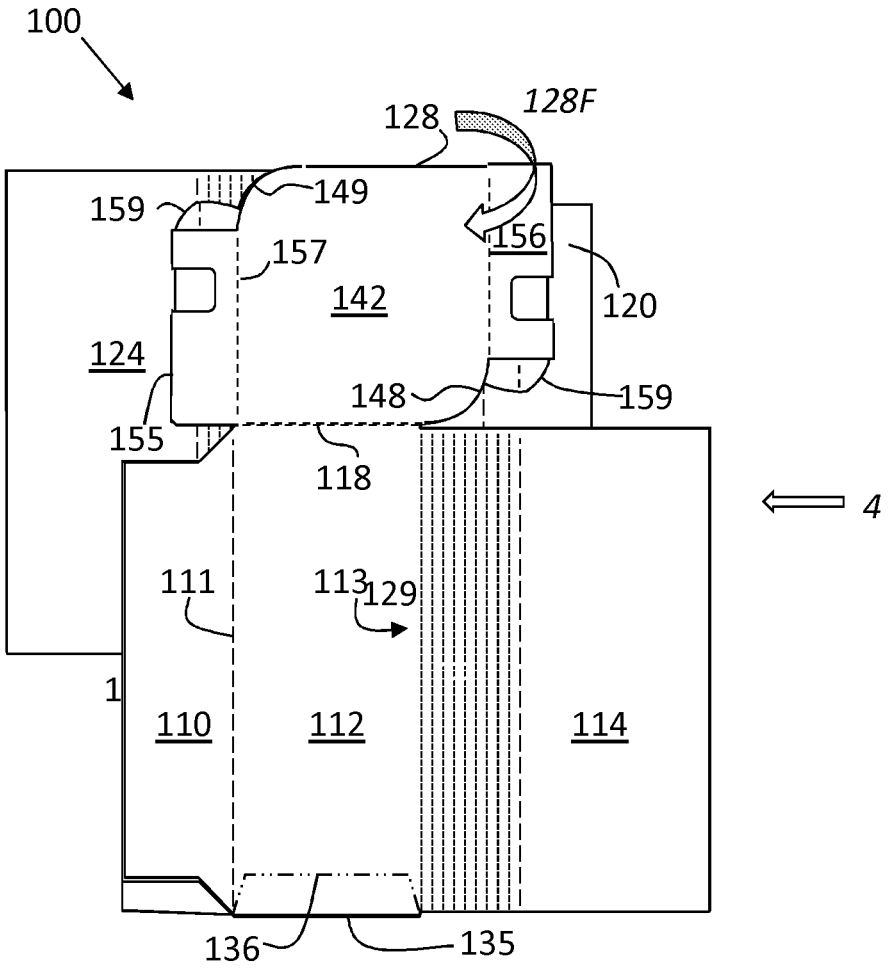
FIG. 3 is a plan view from above of the blank of FIG. 2 after an additional folding step, and forming a flattened tube.

As shown in FIG. 3, the halves of the structure may then be folded together along fold line 128 (according to arrow 128F) bringing the inside of first side panel 112 into contact with the adhesive on glue flap 136. A flattened tubular structure is thereby which may be opened into the open tubular carton 102 shown in FIG. 4.

FIG. 4 shows a perspective view from an end of the carton 102 being loaded with bottles B. During loading the buttress structure (panels 156 and others) is still generally in a flattened state during loading as evidenced by buttress outer panel 156 being in a generally horizontal orientation.

Figure 5:
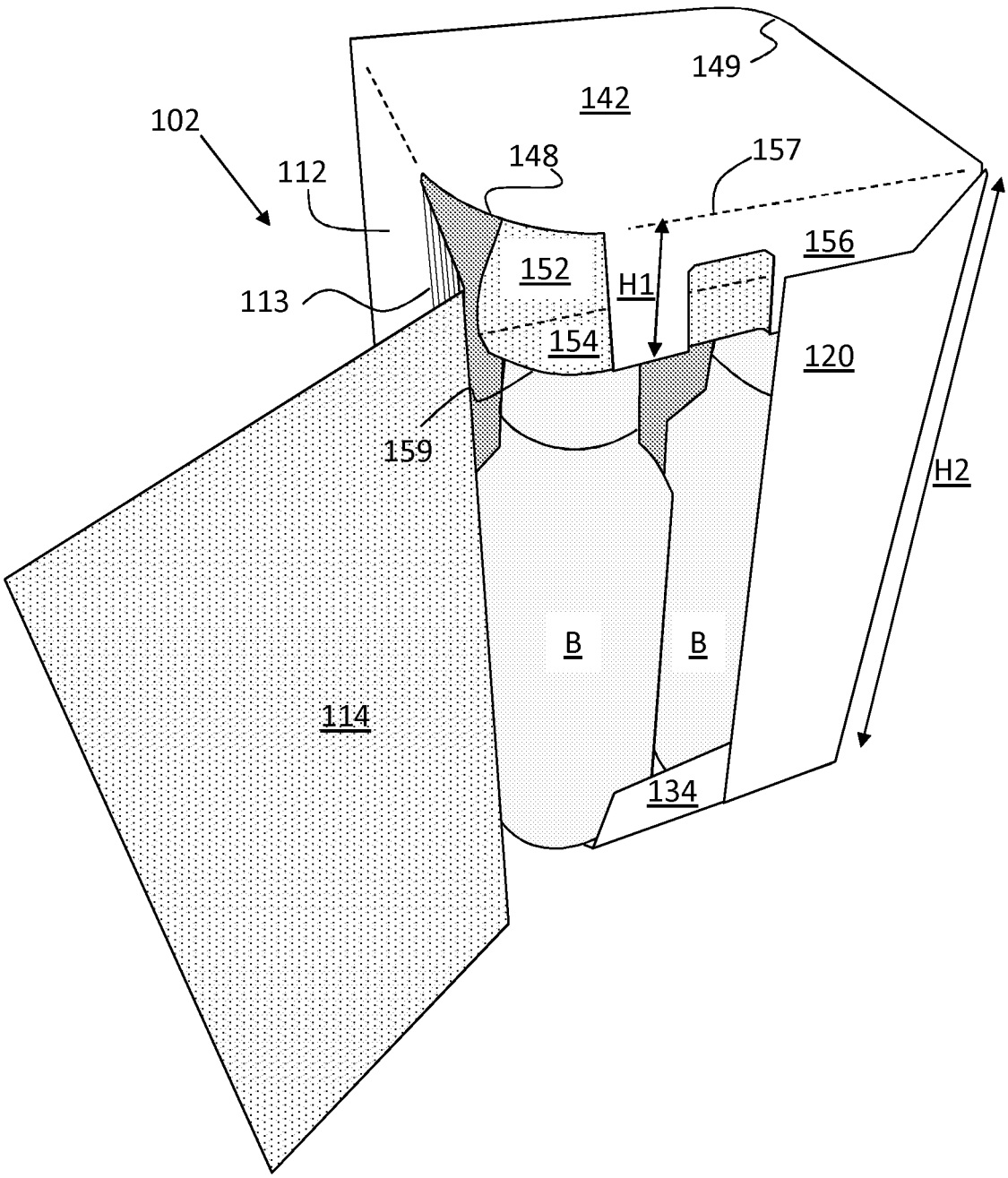
FIG. 5 is a perspective view from an end of the carton of FIG. 4, with certain panels folded inward.

Once loading is finished, the buttress structure may be pressed inward as shown in FIG. 5, which brings the buttress outer panel 156 and buttress inner panel 152 into vertical orientation. The aperture 158 may provide access for machine equipment to help in opening up the tubular buttress. The buttress may be considered a rectangular tube with its four bounding surfaces being the top panel 142, buttress outer panel 156, buttress floor panel 154, and buttress inner panel 152. The distance across the buttress floor panel from the buttress outer panel 156 to the buttress inner panel 152 may be chosen to substantially fill the 'empty' space between the outer walls 114, 120 of the carton and the nearest bottles B within the carton. Thus the buttress inner panel 152 may rest against the necks of bottles B to prevent excessive movement of the bottles. By dimensioning the buttress tube to substantially fill the 'empty' space, the buttress outer panel 156 may be held securely in position for gluing to the side end panels 114, 120. The curved edge 159 of buttress floor panel 154 meanwhile provides a firm support for the upper part of curved panel 113, while the lower part of curved panel 113 will be supported by the body of the corner bottle B. Thus, the curved panel 113 may be formed without fear of that the upper part of the curved panel might collapse inward for lack of internal support. The buttress floor panel 154 and the curved edge 159 may be located a distance H1 below top panel 142. The distance H1 may be at least 10% of the carton height H2, or at least 15% of H2, or at least 20% of H2. The distance H1 may be made longer for long-neck bottles B. Also, the width of the buttress floor panel 154 between buttress outer panel 156 and buttress inner panel 152 may be chosen according to the type of bottle contained in the carton. As an example, the width of the buttress floor panel 154 may be approximately the difference between the radius of the lower portion of the bottle and the radius of the bottle neck.

With the buttress formed into a tube, the bottom end panel 134 may be folded upward, and the side end panel 120 may be folded inward and glued to the outer surface of bottom end panel 134 and buttress outer panel 156.

Figure 6:
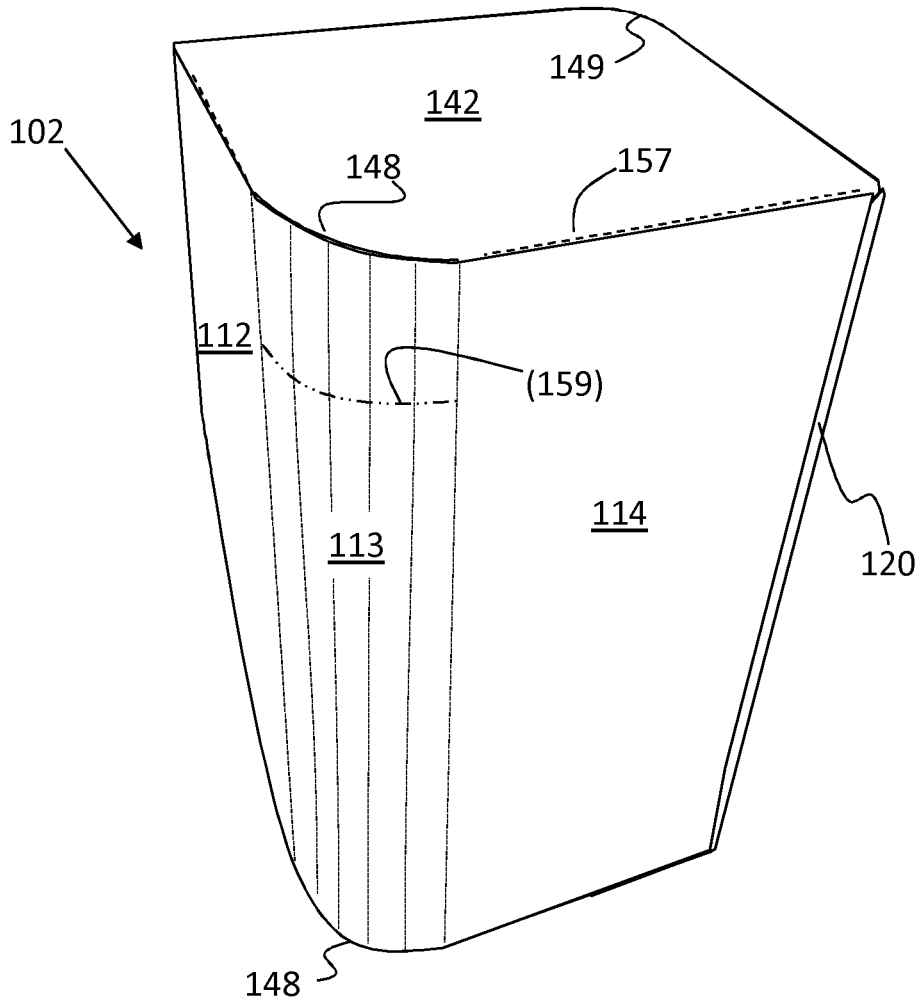
FIG. 6 is a perspective view from an end of the carton of FIG. 5, in a finished state.

Next, as shown in FIG. 6, the other side end panel 114 may be folded inward and glued in place, completing the finished carton 102.

A second embodiment of a carton 202 made from a blank 200 is shown in FIGS. 7-19.

Figure 7:
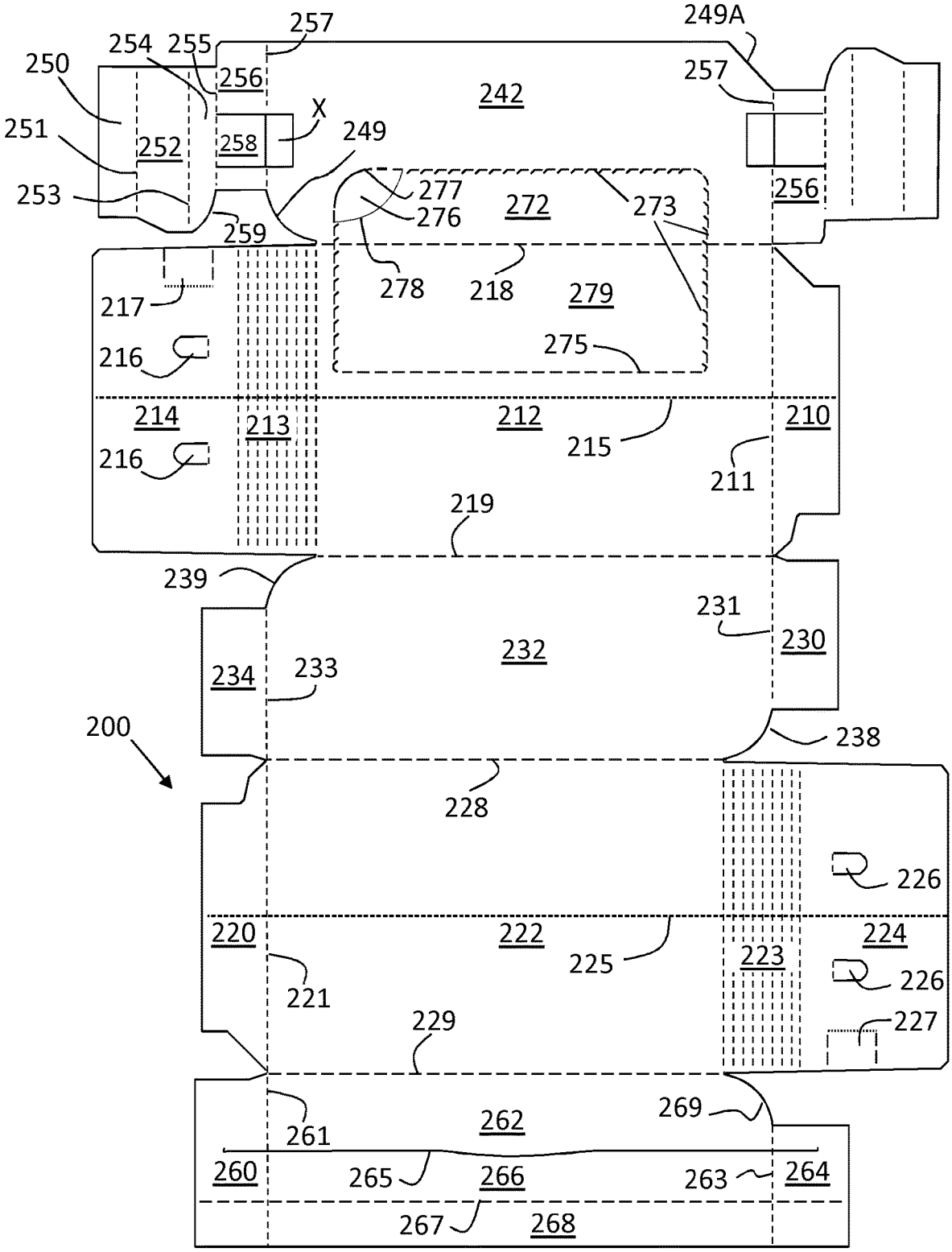
FIG. 7 is a plan view from above of a blank for forming a carton according to a second embodiment.

As shown in FIG. 7, blank 200 includes a plurality of main panels 242, 212, 232, 222, 262 hinged one to the next in a linear series. Blank 200 includes a first top panel 242 hinged to a first side panel 212 by a fold line 218. The first side panel 212 is hinged to a bottom panel 232 by a fold line 219. The bottom panel 232 is hinged to a second side panel 222 by a fold line 228. The second side panel 222 is hinged to second top panel 262 by a fold line 229.

Each of the first side panel 212 and second side panel 222 are bisected by lateral fold lines 215, 225 that will be used to temporarily flatten carton 202 after it has been glued into a tubular form.

The plurality of main panels 242, 212, 232, 222, 262 of the blank 200 form the walls of an open ended tubular structure (see FIGS. 11, 13) in a set up condition.

Each of the ends of the tubular structure is at least partially closed by end panels, which form end walls of the tubular structure. In the illustrated embodiment (starting from the top of FIG. 7, running down the right side) a first end of the tubular structure is closed by a buttress outer panel 256 of a first buttress structure (hingedly connected to first top panel 242 through fold line 257), first side end panel 210 (hingedly connected to first side panel 212 through fold line 211), a bottom end panel 230 (hingedly connected to bottom panel 232 through fold line 231), second side end panel 224 (hingedly connected to second side panel 222 through a curved panel 223), and top end panel 264 (hingedly connected to second top panel 262 through fold line 263).

In a similar manner, a second end of the tubular structure is closed by buttress outer panel 256 of a second buttress structure (hingedly connected to first top panel 242 through fold line 257), side end panel 214 (hingedly connected to first side panel 212 through curved panel 213), a bottom end panel 234 (hingedly connected to bottom panel 232 through fold line 233), side end panel 220 (hingedly connected to second side panel 222 through a fold line 221), and top end panel 260 (hingedly connected to second top panel 262 through fold line 261).

The curved panels 213, 223 may be provided with a plurality of vertical score lines to facilitate forming a smoothly curved panel when the carton is finished.

The first and second buttress structures each include a buttress outer panel 256 hingedly connected to top panel 242 through fold line 257, a buttress floor panel 254 hingedly connected to buttress outer panel 256 through fold line 255, a buttress inner panel 252 hingedly connected to buttress floor panel 254 through fold line 253, and buttress glue panel 250 hingedly connected to buttress inner panel 252 through fold line 251.

As seen in FIG. 7, each of the buttress structures is attached to top panel 242 through a fold line 257. For one buttress structure (at the left side of FIG. 7), curved corner 259 is joined through buttress outer panel 256 to a curved corner 249 on the top panel. The shapes of curved corners 259 and 249 may at least partially be mirror images and may have the same radius. Curved corner 249 on top panel 242 may be aligned with a curved panel 213 extending from an adjacent side panel 212. Curved top corner 249 may also be aligned with curved corner 239 on bottom panel 232. The same alignment is maintained in the finished carton 202 as shown on FIG. 17.

For the other buttress structure (at the right side of FIG. 7), curved corner 259 is joined through buttress outer panel 256 to a corner 249A of top panel 242. Although this corner 249A could be curved, it is shown as a bevel in FIG. 7. Corner 249A may be aligned with (and in the finished carton, superimposed upon) curved corner 269 of second top panel 262. The shapes of curved corners 259 and 269 may at least partially be mirror images and may have the same radius. Curved corner 269 on top panel 262 may be aligned with a curved panel 223 extending from an adjacent side panel 212. Curved corner 269 may also be aligned with curved corner 238 on bottom panel 232. The same alignment is maintained in the finished carton 202 shown on FIG. 16.

After assembly, at one end of the carton the curved corners 249, 259 may be aligned with curved corner 239 of bottom panel 232. After assembly, at the other end of the carton the curved corners 249, 269 may be aligned with curved corner 238 of bottom panel 232.

For machine access during assembly of the carton, pull holes 216, 226 may be provided in side end panels 214, 224.

To help anchor the ends of the handle structure, flaps 217, 227 may be provided on the upper edge of side end panels 214, 224, and flaps 258 may be provided in buttress outer panels 256. Handle clearance openings X may be provided on top panel 242 adjacent flaps 258.

The second top panel 262 may overlap the first top panel 242. A handle strap 266 may be provided in the second top panel 242, and separated therefrom by a cut line 265 which may include temporary nicks to hold the handle strap 266 in place. Also formed in second top panel 262 may be a reinforcement strap 268 that may be folded under handle strap 266 along fold line 267. The ends of the handle strap 266 and reinforcement strap 268 may extend onto the top end flaps 260, 264 and in the finished carton 202 may overlap or coincide with flaps 258, 217 on one end and flaps 258, 227 on the other end.

The handle strap 266 is defined in part by a severance line 265 which extends longitudinally across the second top panel 262 and into each of the top end panels 260, 264. The severance line 265 terminates with a "J" or "C" shaped cut line portion.

For description purposes, blank 200 in FIG. 7 may be considered as showing the interior surface of the carton. For initial setup into a flat tubular structure, glue or adhesive may be provided for example onto the buttress glue panels 250 (or a corresponding area on first top panel 242) and onto handle reinforcement strap 268 (or a corresponding area on handle strap 266).

Figure 8:
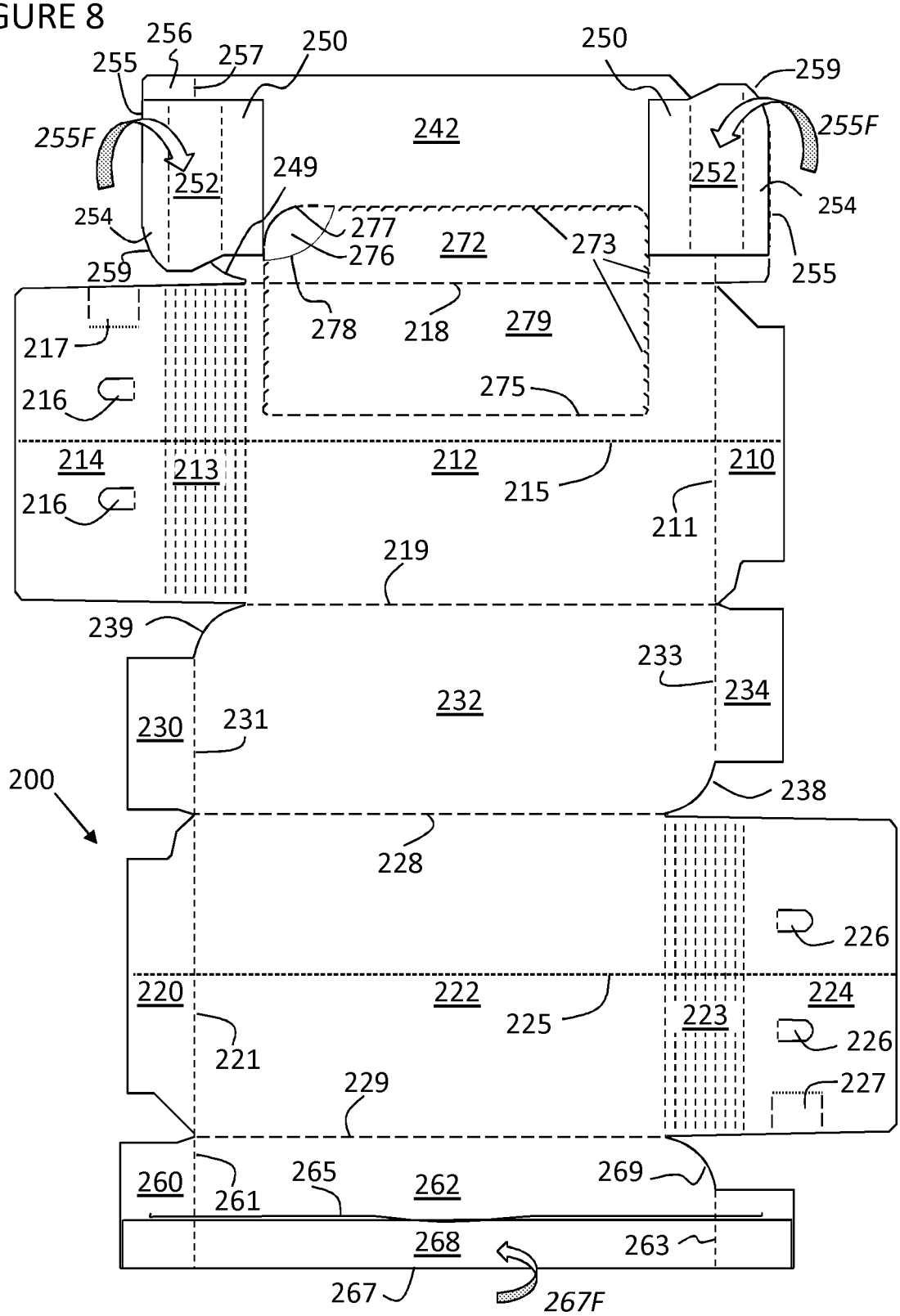
FIG. 8 is a plan view from above of the blank of FIG. 7 after certain portions are folded.

Next, as shown in FIG. 8, the buttress structures may be folded inward along fold line 255 (as denoted by arrows 255F) onto first top panel 242, forming flattened buttress tubes. The handle reinforcement strap 268 may be folded inward along fold line 267 (as denoted by arrow 267F) onto the handle strap 266, forming a two-ply handle.

Figure 9:
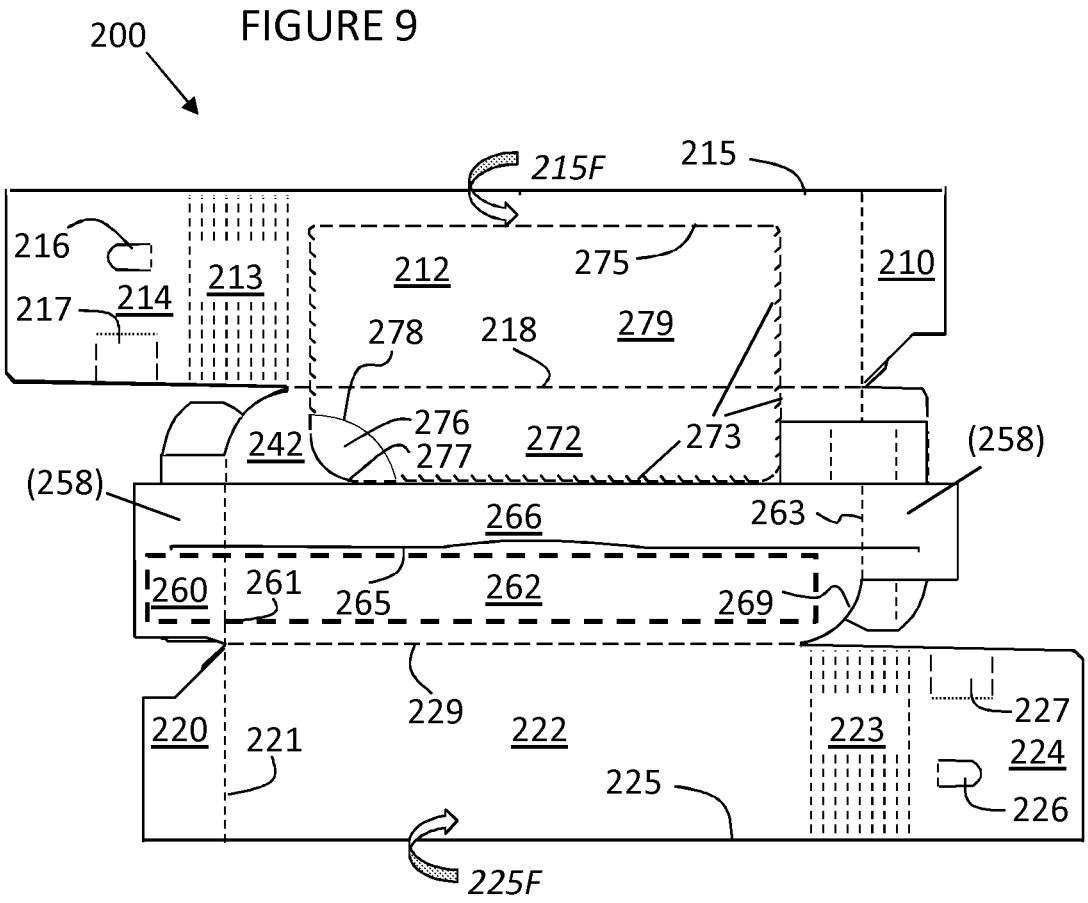
FIG. 9 is a plan view from above of the blank of FIG. 8 after an additional folding step, and forming a flattened tube.
Figure 10:
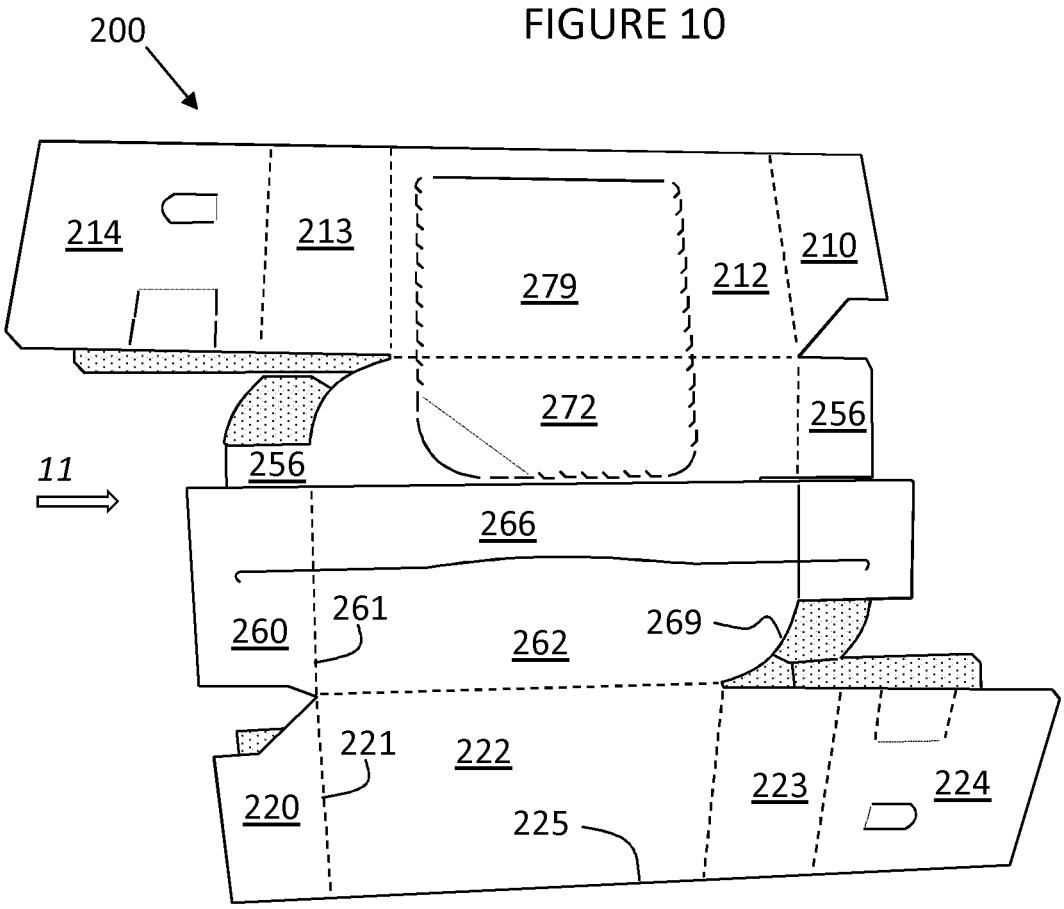
FIG. 10 is a perspective view from above of tube of FIG. 9, the tube now having been partially opened.
Figure 11:
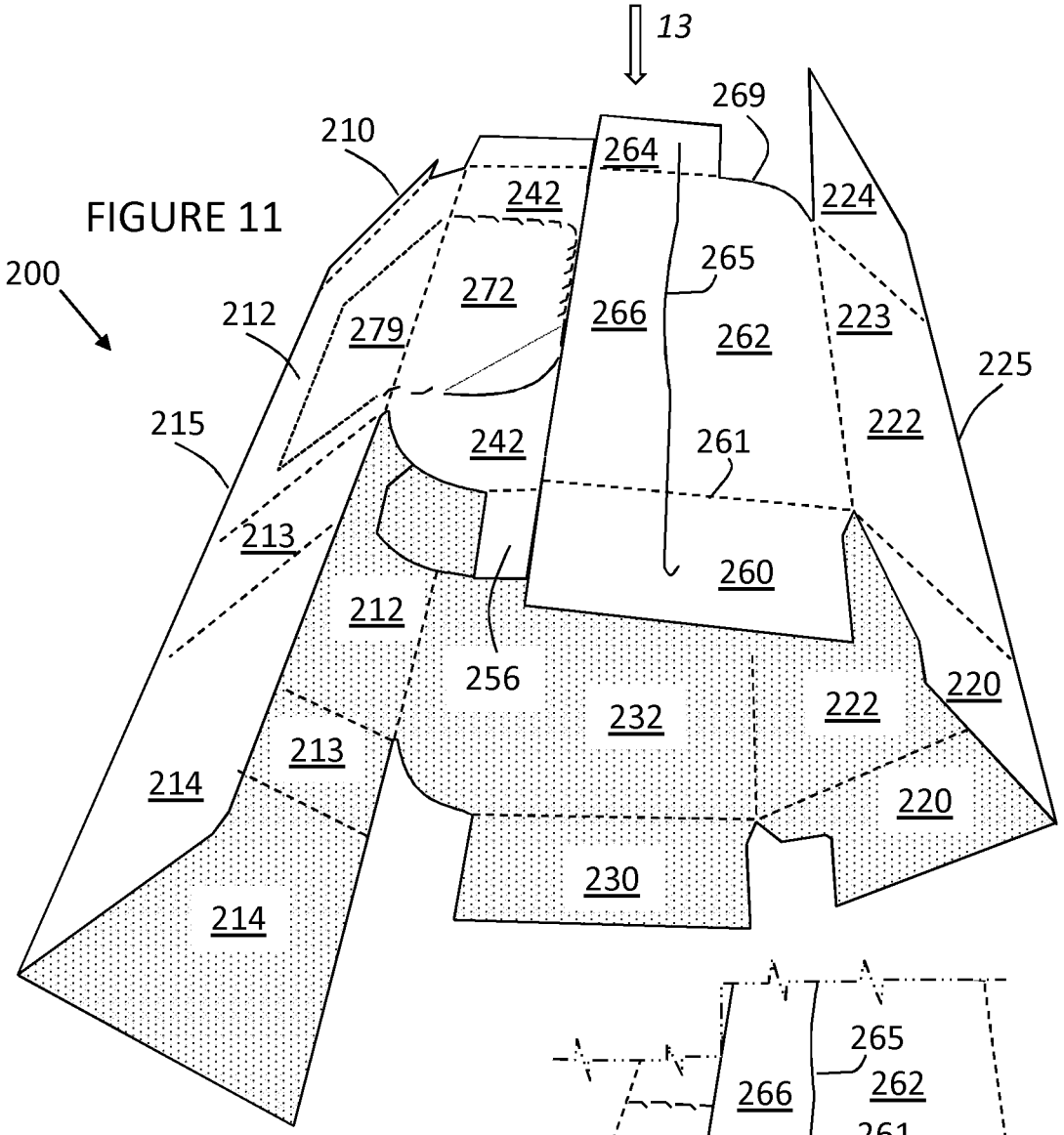
FIG. 11 is a perspective view from an end of the partially opened tube of FIG. 10.

As shown in FIG. 9, the side panels 212, 222 may then be folded together along their respective lateral fold lines 215, 225 (according to arrows 215F, 225F) bringing the first top panel 262 (with attached handle strap 266) to overlap second top panel 242. Glue may be used to hold together the top panels 262, 242 in the area shown in heavy dotted lines in FIG. 9. Glue may also be used to hold together the ends of handle strap 266 (or reinforcement strap 268) where it contacts the flaps 258 on the outer buttress panels. (See FIGS. 7 and 12). The result of the folding and gluing shown on FIG. 9 is a flattened tubular structure. The same structure is shown in FIG. 10, being partially opened although still generally flat in appearance. FIG. 11 shows a perspective view from an end of the partially opened tubular structure.

Figure 12:
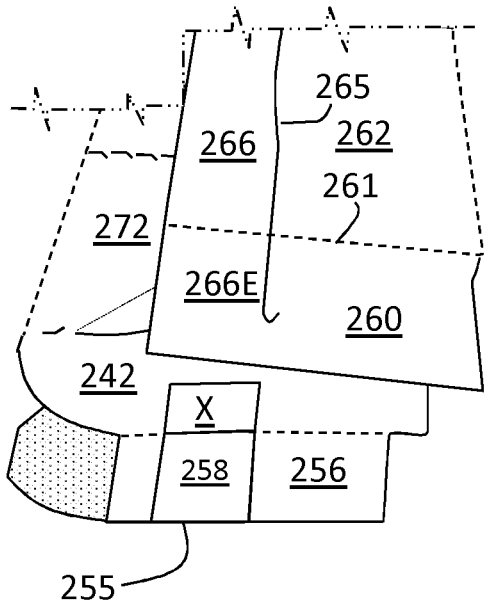
FIG. 12 is a detail exploded view of certain panels of the structure of FIG. 11.

FIG. 12 is a detail view of the end of top panels 242, 262 partially separated to show how the ends 266E of handle strap 266 overlap (and are eventually glued to) flaps 258 on the buttress outer panel 256. Also, the portion of handle 266 near fold line 261 is positioned over the aperture X in first top panel 242. When the handle 266 is eventually deployed (lifted), it will be anchored more securely by its attachment to flap 258, and the handle will be able to flex inward due to aperture X.

Figure 13:
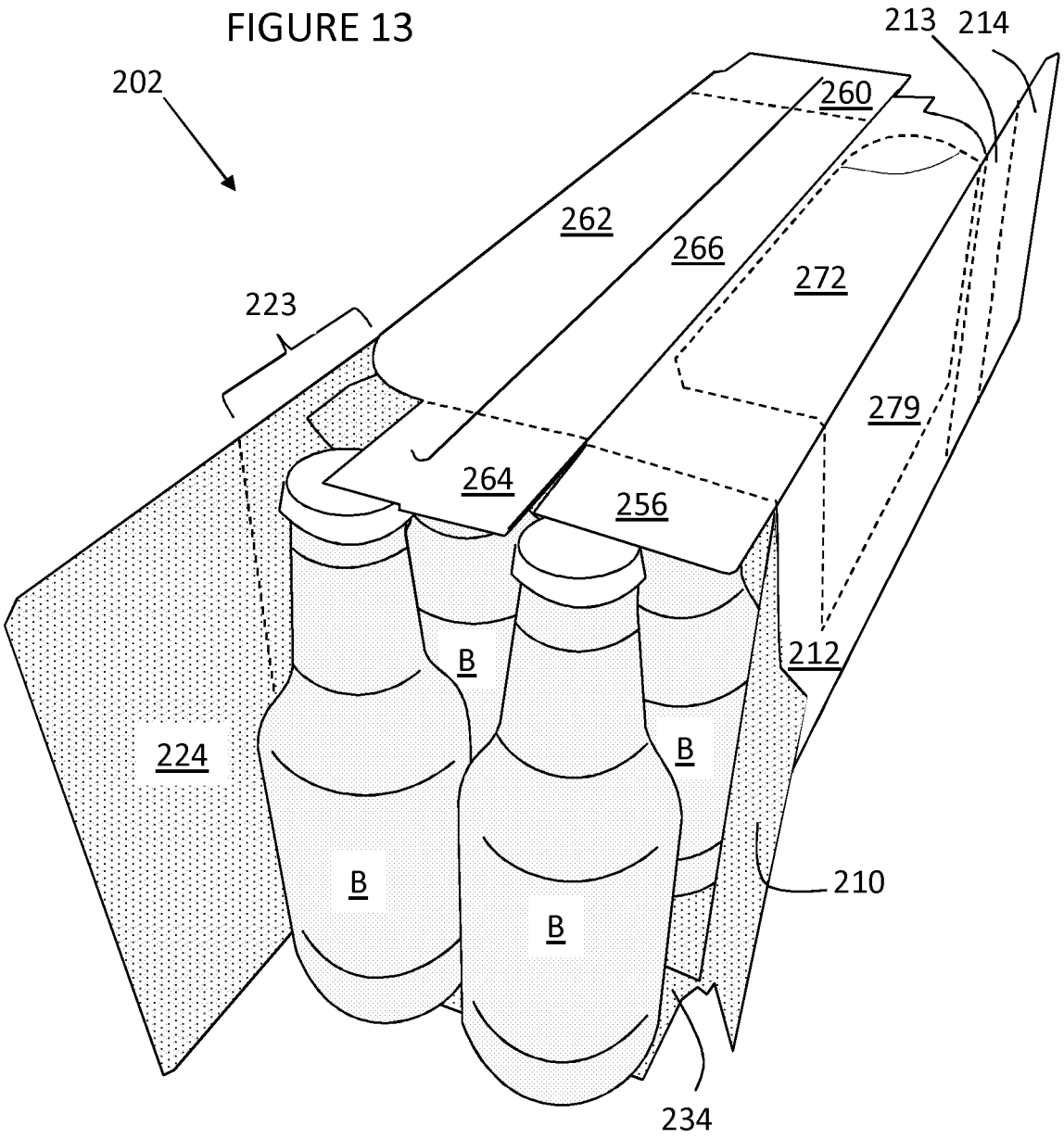
FIG. 13 is a perspective view from an end of a carton formed from the tube of FIG. 11, during loading with primary product containers.

The flattened tubular structure, this formed, may be opened into the open tubular carton 202 shown in FIG. 13.

Figure 14:
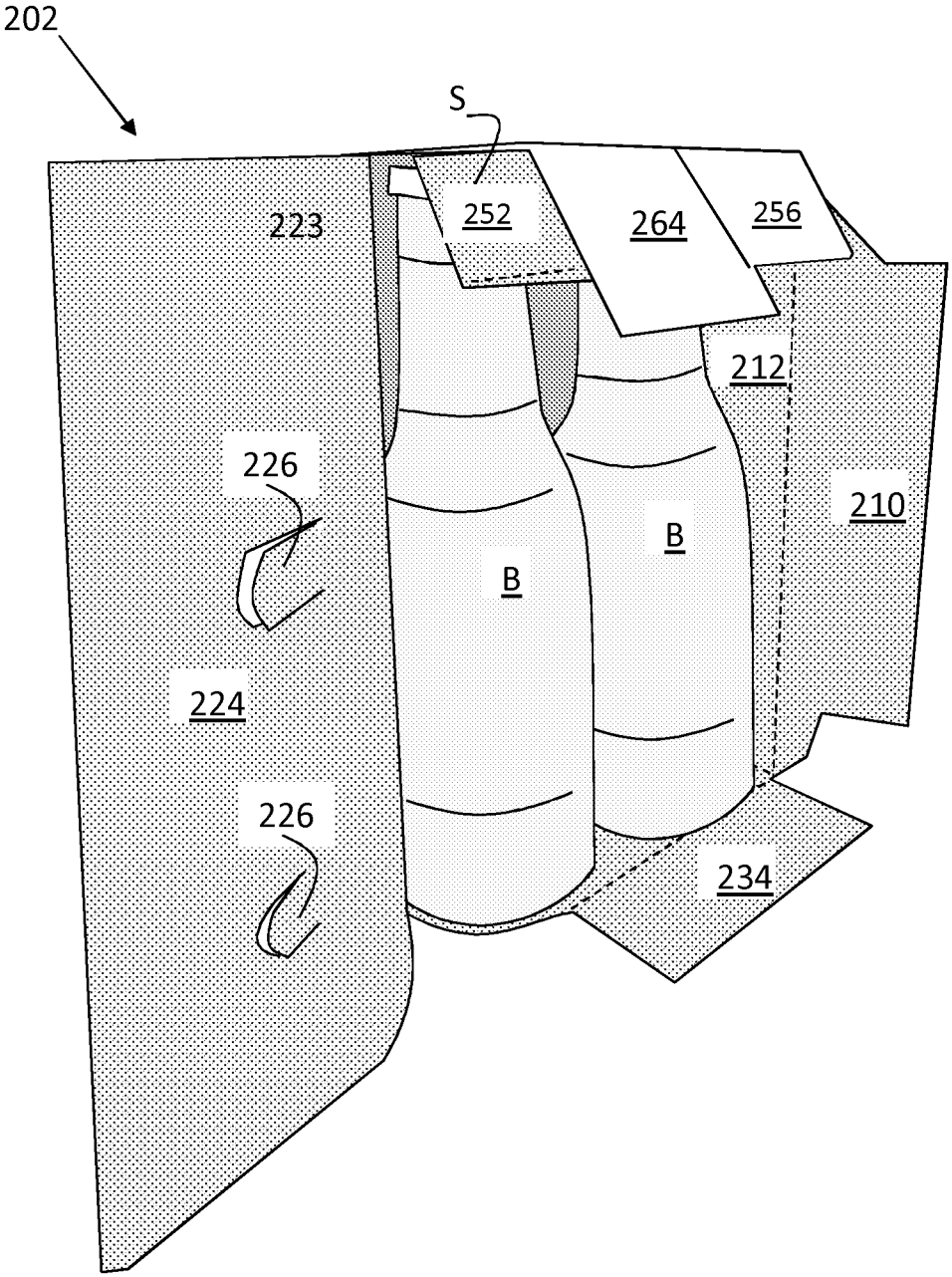
FIG. 14 is a perspective view from a side of an internal buttress being formed inside the carton of FIG. 13.

FIG. 13 shows a perspective view from an end of the carton 202 being loaded with bottles B. In FIG. 13, and during loading, the buttress structure is still generally in a flattened state. Once loading is finished, the buttress structure S may be pressed inward as shown in FIG. 14, which brings the buttress outer panel 256 and buttress inner panel 252 into vertical orientation. The buttress inner panel 252 may rest against the necks of bottles B to prevent excessive movement of the bottles. The buttress outer panel 256 may be held securely in position for gluing to the side end panels 224, 210.

The curved edge 259 of buttress floor panel 254 meanwhile provides a firm support for the upper part of curved panel 223, while the lower part of curved panel 223 will be supported by the body of the corner bottle B. Thus, the curved panel 223 may be formed without fear of its upper part collapsing inward for lack of internal support.

Figure 15:
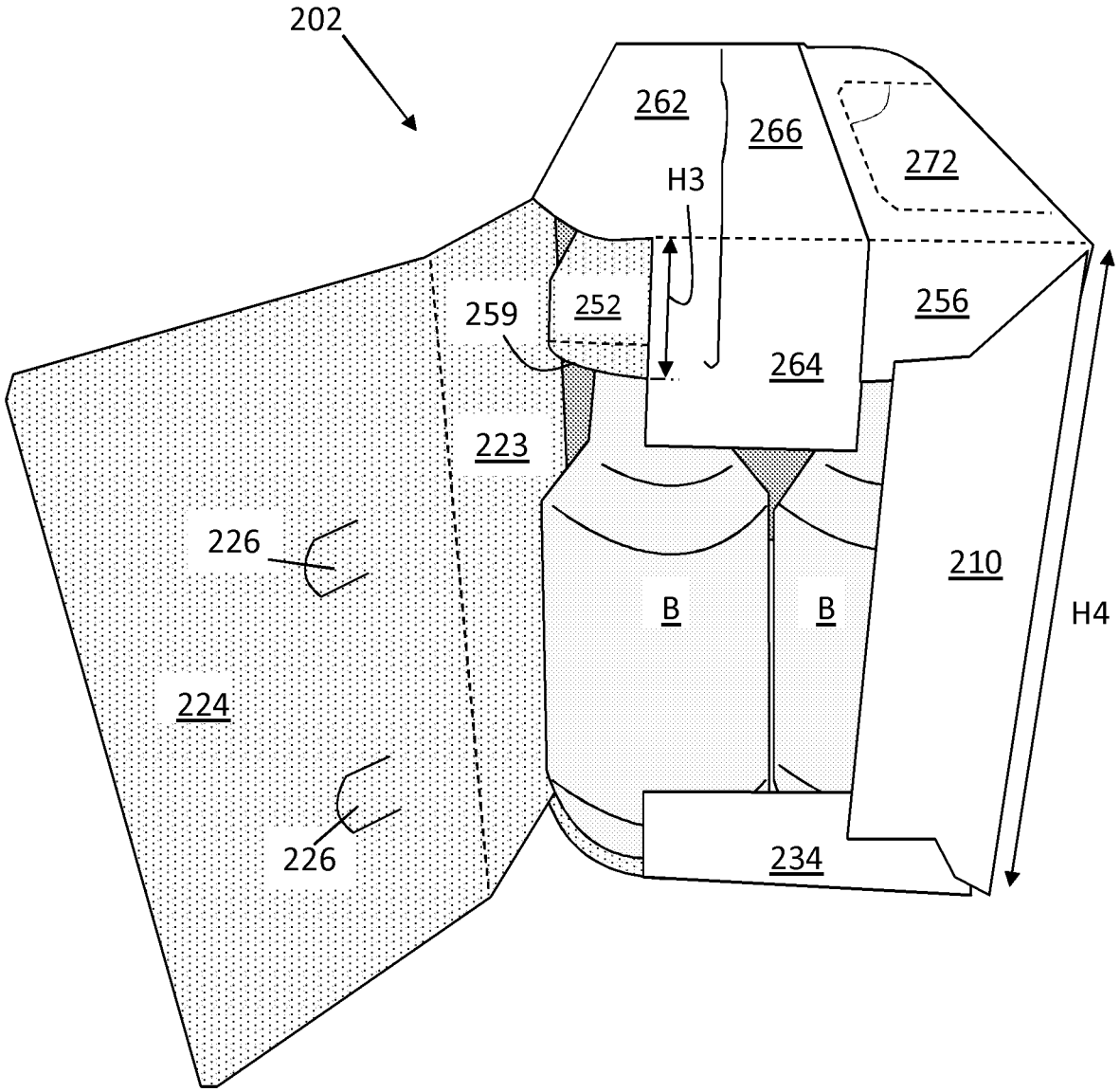
FIG. 15 is a perspective view from an end of the carton of FIG. 14, with additional panels folded inward.

As shown in FIG. 15, pull holes 226 may be provided in side end panel 224. The pull holes provide access for machine equipment to help in opening verifying proper closure of the end panels when they are glued together.

With the buttress formed into a tube, the bottom end panel 234 may be folded upward, and the side end panel 210 may be folded inward and glued to the outer surfaces of bottom end panel 234 and buttress outer panel 256. The buttress floor panel 254 with its curved edge 259 may be located a distance H3 below top panel 242. The distance H3 may be at least 10% of the carton height H4, or at least 15% of H4, or at least 20% of H4.

Figure 16:
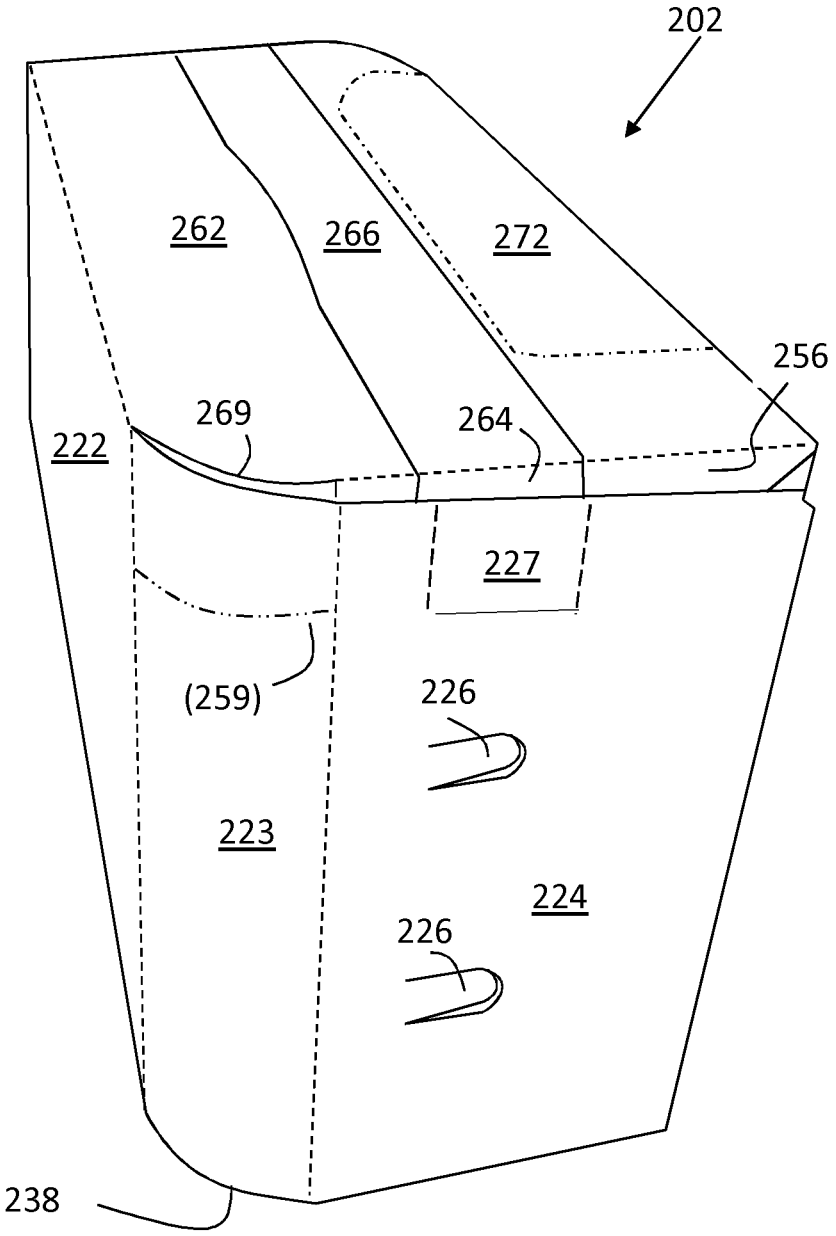
FIG. 16 is a perspective view from an end of the carton of FIG. 15, in a nearly finished state.

Next, as shown in FIG. 16, the other side end panel 224 may be folded inward and glued in place, completing the finished carton 202 (the carton 202 in FIG. 16 is shown just before gluing the side panel 224 in place).

Figure 17:
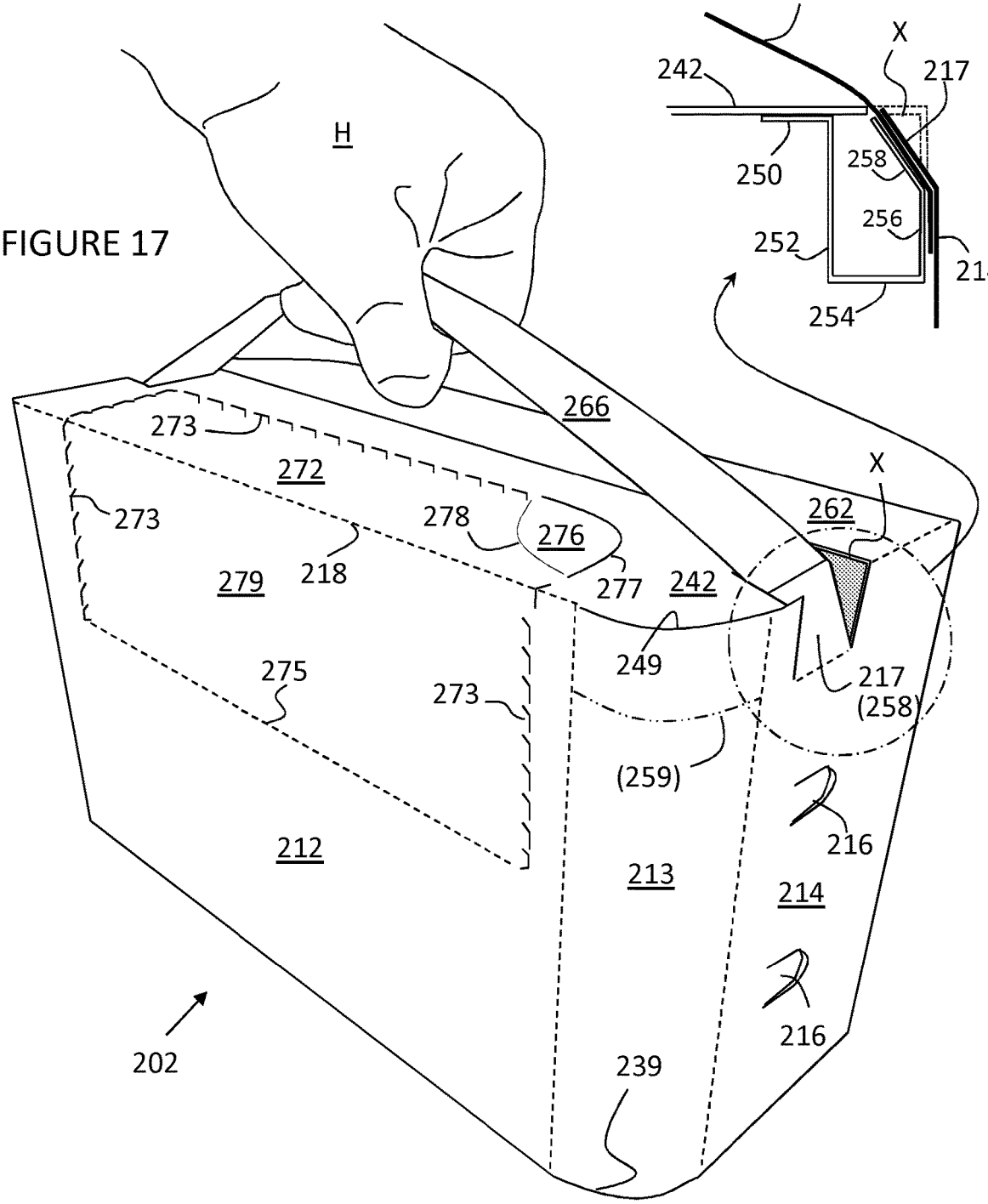
FIG. 17 is a perspective view from a side of the carton of FIG. 16, being lifted by its handle.

FIG. 17 shows how a user may pick up carton 202 with his hand H engaging the handle strap 266 (breaking loose the separation line 265) and lifting the handle upward. The ends of the handle 266, besides being attached to top end panels 260, 264, are also glued to flaps 258, 217, 227 for additional support. Also, apertures X in top panel 242 allow the handle to pull inwardly for an easier, stronger deployment.

Figure 18:
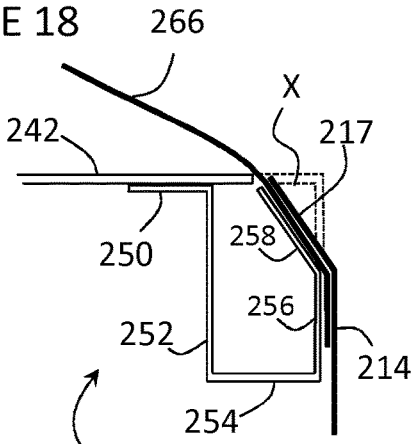
FIG. 18 is a cross section detail view of the carton of FIG. 17, showing the end of the handle passing through the internal buttress.

FIG. 18 shows a detail cross section view of the end of the deployed handle 266 and how it is attached to the rest of the carton. The end of handle 266 is glued between flap 217 extending at the top edge of end panel 214, and flap 258 formed in the outer wall 256 of the internal buttress. When handle 266 is lifted upward, its ends pull inwardly and flex into the aperture X in the top wall 242.

Figure 19:
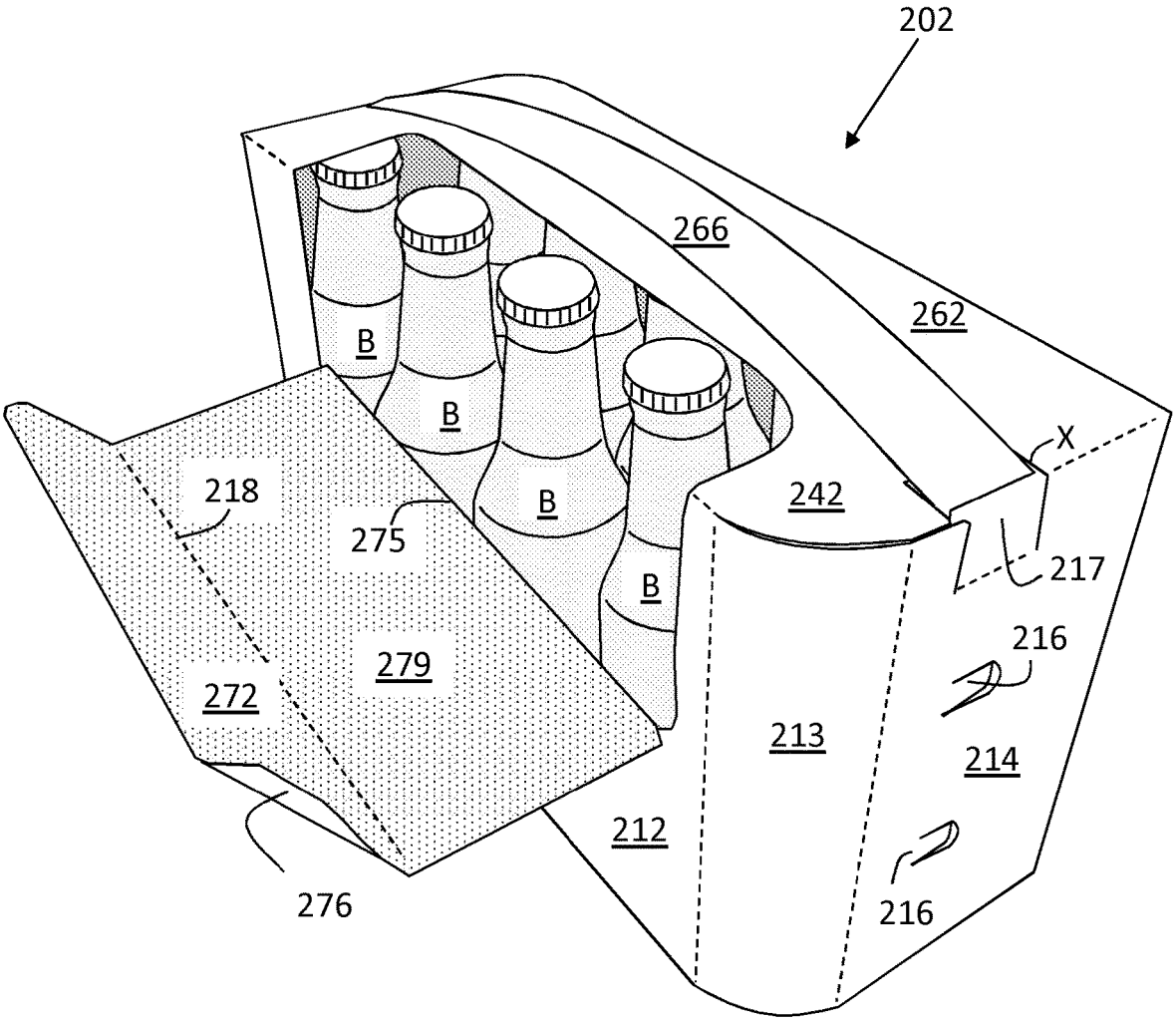
FIG. 19 is a perspective view from the side of the carton of FIG. 17, having been opened.

FIG. 19 shows an opened carton 202. A user may press in the opening area 276 (defined between cut line 277 and optional score line 278) to start tearing the carton along perforation or tear lines 273 which may extend across part of the top panel 242 and continue onto the side panel 212. An opening may thereby be created in the top and/or side of the carton, formed by removal or hinging away of access panels 272, 279 on top panel 242 and side panel 212 respectively. Bottles B may be removed through this opening. After removing one or more bottles; access panels 272, 279 may be returned to their original positions by hingedly folding the panels back along fold line 275. Alternately access panels 272, 279 may be torn loose and discarded.

Figure 20:
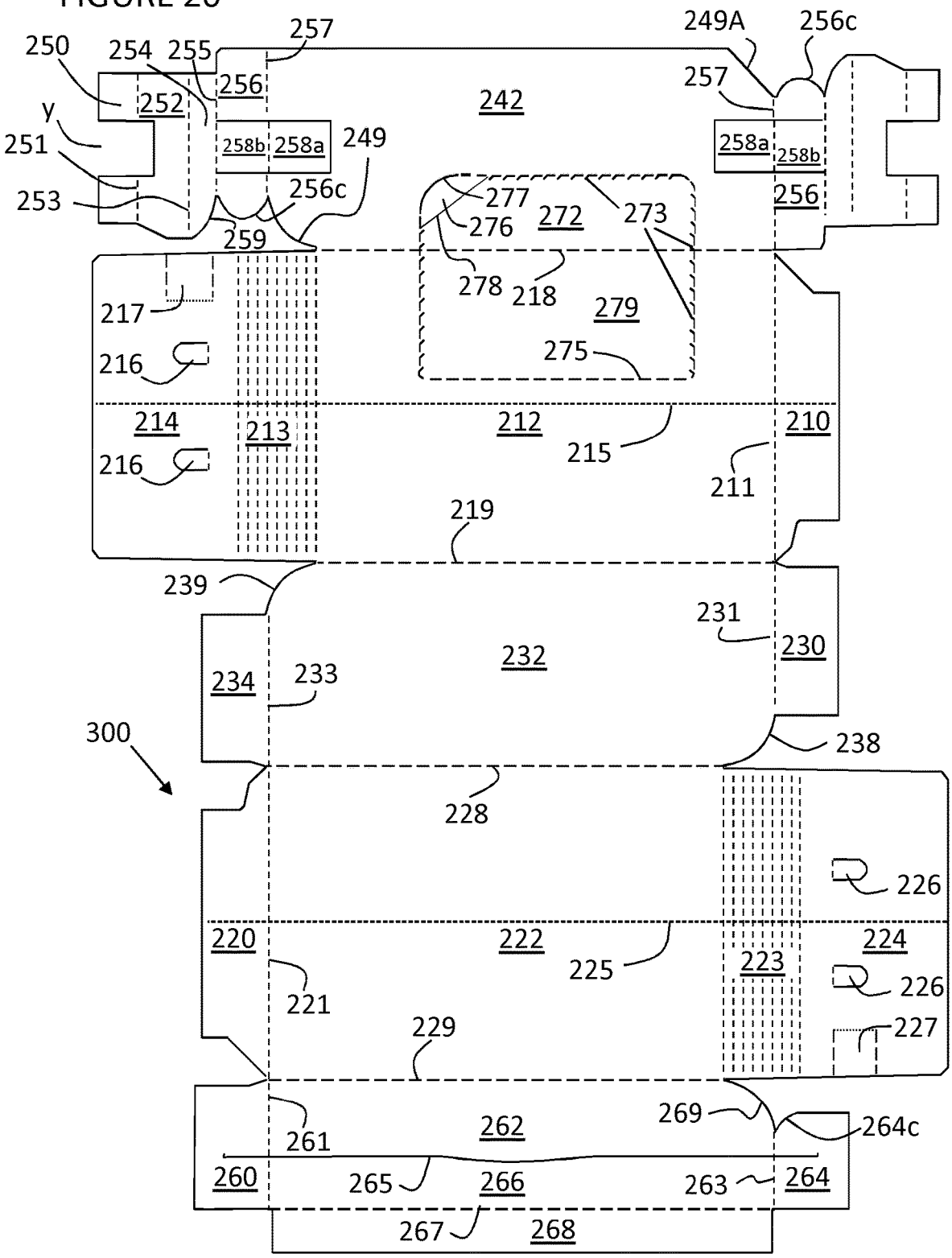
FIG. 20 is a plan view from above of a blank for forming a carton according to a third embodiment.
Figures 21, 22:
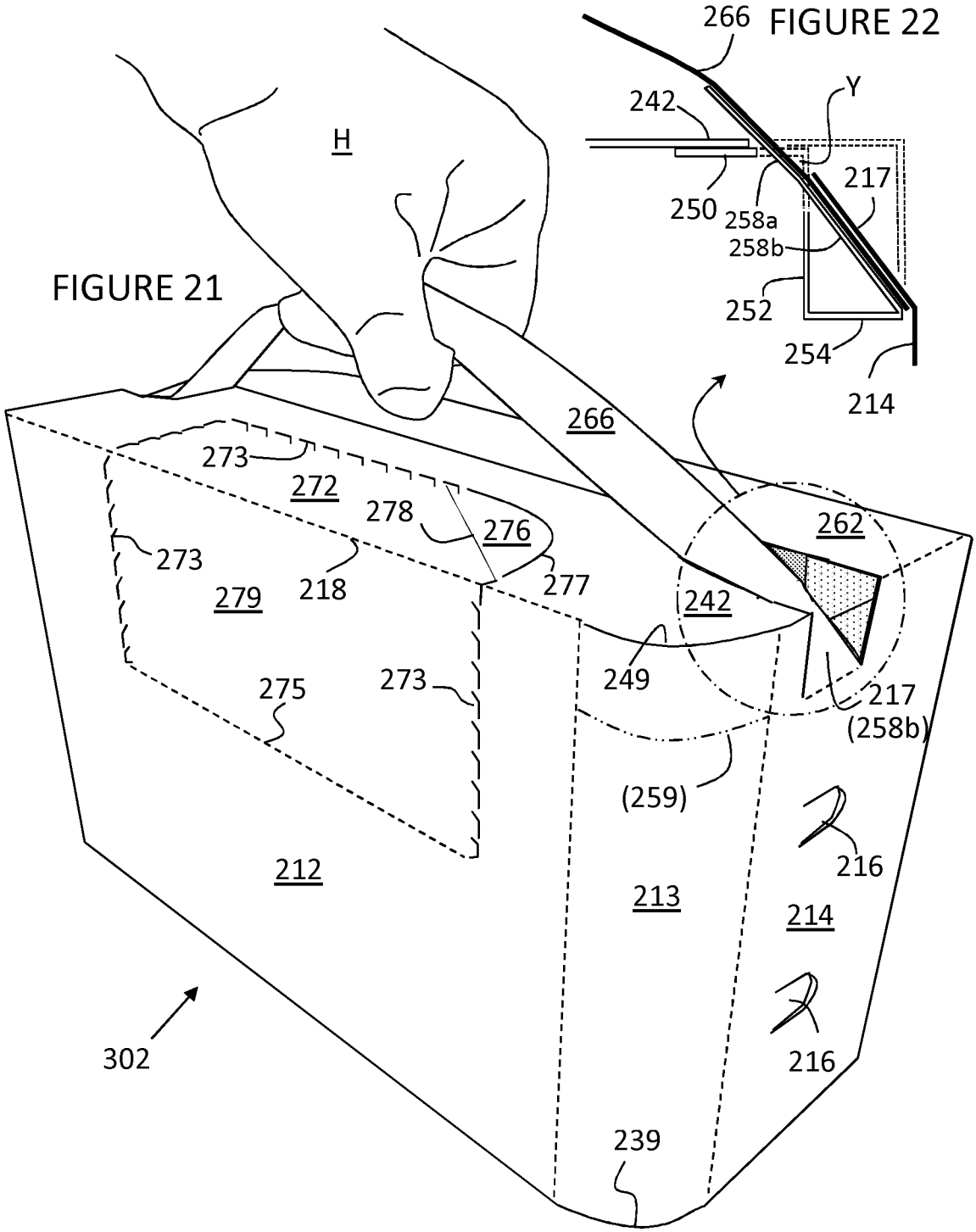
FIG. 21 is a perspective view from the side of the carton formed from the blank of FIG. 20, having been opened.
FIG. 22 is a cross section detail view of the carton of FIG. 21, showing the end of the handle passing through the internal buttress.

A third embodiment of a carton 302 made from a blank 300 is shown in FIGS. 20-22. This embodiment has many features in common with the second embodiment which need not be described again. However, there are certain differences.

The buttress outer panel 256 includes a buttress flap 258*b* which extends across buttress outer panel 256 and onto top pane 242 as flap 258*a*. This buttress flap 258*a*, 258*b* is somewhat longer than the buttress flap 258 of carton 202. To accommodate the longer flap, a cutout area Y is provided in buttress glue panel 250 and buttress inner panel 252. The effect of the longer flap and the cutout area will be best seen in FIG. 22. Flaps 217, 227 in side end panels 214, 224 may be somewhat longer than before in order to cooperate with the longer buttress flap.

The buttress outer panel 256 may have a curved portion 256*c* that may better fit against or help support curved panels 213, 223. Likewise handle end panel 264 may have a curved portion 264*c* to better fit against or support curved panel 223.

FIG. 21 shows how a user may pick up carton 302 with his hand H engaging the handle strap 266 (breaking loose the separation line 265) and lifting the handle upward. The ends of the handle 266, besides being attached to top end panels 260, 264, are also glued to flaps 258*a*, 258*b*, 217, 227 for additional support. Also, the space in top panel 242 left by flap 258*a*, as well as the cutout Y in buttress inner wall 252 and buttress glue flap 250 allow the handle to pull further inward for an easier, stronger deployment.

FIG. 22 shows a detail cross section view of the end of the deployed handle 266 and how it is attached to the rest of the carton. The end of handle 266 is glued between flap 217 extending at the top edge of end panel 214, and flap 258*b* formed in the outer wall 256 of the internal buttress which continues as flap 258*a* struck from the top wall 242. When handle 266 is lifted upward, its ends pull inwardly and flex into the interior of the buttress tube aperture. The ends may pull inwardly beyond the buttress tube itself due to the cutout Y provided in the buttress internal wall 252 and buttress glue flap 250.

Figure 23:
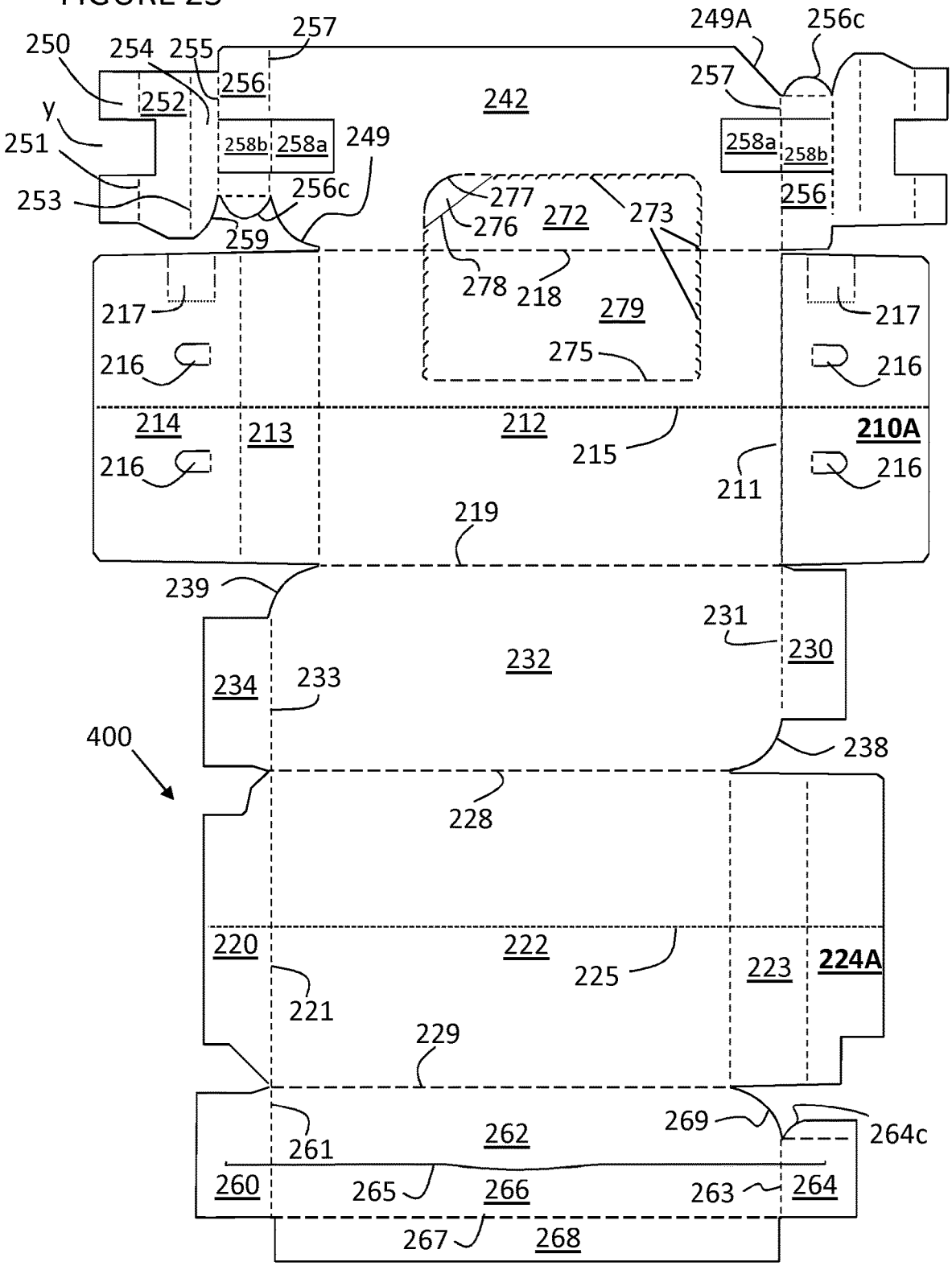
FIG. 23 is a plan view from above of a blank for forming a carton according to a fourth embodiment.

A fourth embodiment of a carton may be made from blank 400 shown in FIG. 23. Blank 400 is very similar to blank 300, except for placement of certain end panels. In particular, first side end panel 210A (hingedly connected to first side panel 212 through fold line 211) is longer in blank 400 than corresponding first side end panel 210 in blank 300. Likewise, second side end panel 224A (hingedly connected to second side panel 222 through a curved panel 223) is shorter in blank 400 than corresponding second side end panel 224 in blank 300. Therefore, the end panels may be somewhat more symmetrical about the long axis for blank 400 than for blank 300. This may be advantageous for machinery handling the blank as it is formed into a carton.

While the embodiments shown here use primary product containers that are generally cylindrical, it should be understood that other shapes of containers may also be accommodated within the described cartons. Also, while the described cartons have two curved corners at opposing edges of the carton, it should be understood that the cartons may be designed to have two curved corners positioned on one side or one end of the carton. Also, the carton may be designed to have one, three, or four curved corners.

Figure 24:
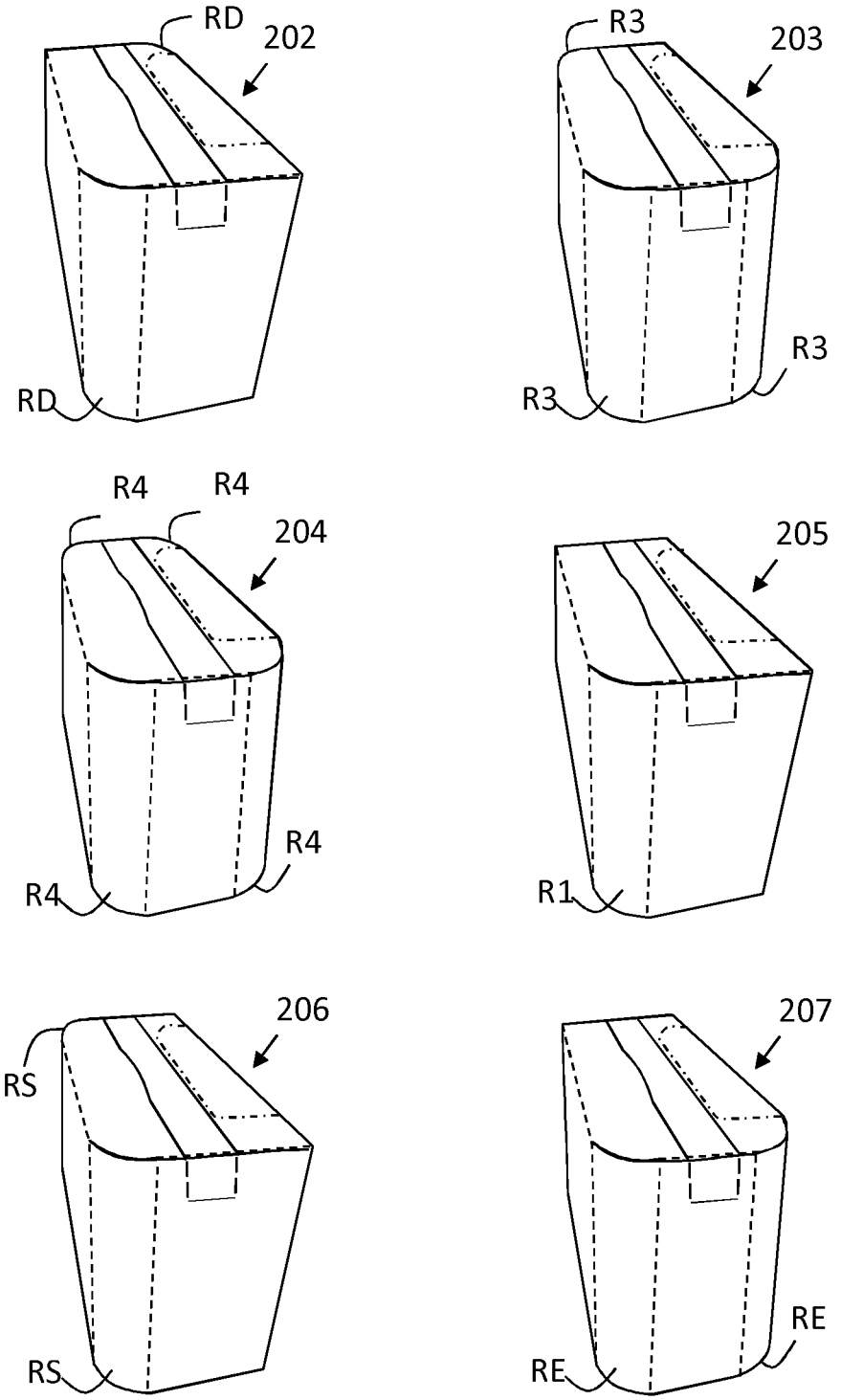
FIG. 24 shows perspective views of cartons with various curved corner arrangements.

FIG. 24 shows cartons with various combinations of curved corners. Carton 202 has already been described, and has two curved corners RD located diagonally opposite from one another on the carton. Carton 203 has three curved corners R3. Carton 204 has four curved corners R4. Carton 205 has a single curved corner R1. Carton 206 has two curved corners RS on one side of the carton. Carton 207 has two curved corners RE on one end of the carton.

In alternative embodiments, instead of using glue or adhesive, panels may be fastened together by other securing means for example, but not limited to, staples or other mechanical fixing means.

It can be appreciated that various changes may be made within the scope of the present invention. For example, the size and shape of the panels and apertures may be adjusted to accommodate articles of differing size or shape.

It will be recognized that as used herein, directional references such as "top", "bottom", "base", "front", "back", "end", "side", "inner", "outer", "upper" and "lower" do not necessarily limit the respective panels to such orientation, but may merely serve to distinguish these panels from one another.

As used herein, the terms "hinged connection" and "fold line" each refer to all manner of lines that define hinge features of the blank, facilitate folding portions of the blank with respect to one another, or otherwise indicate optimal panel folding locations in the blank or substrate of sheet material. Any reference to "hinged connection" should not be construed as necessarily referring to a single fold line only; indeed, a hinged connection can be formed from one or more fold lines.

As used herein, the term "fold line" may refer to one of the following: a scored line, an embossed line, a debossed line, a line of perforations, a line of short slits, a line of half-cuts, a single half-cut, an interrupted cut line, aligned slits, a line of short scores and any combination of the aforesaid options, without departing from the scope of the invention.

As used herein, the terms "severance line" refers to all manner of lines formed in the blank of substrate that facilitate separating portions of the blank or substrate of sheet material from one another, or otherwise that indicate optimal separation locations on the blank or substrate. As used herein, the term "severance line" may refer to one of the following: a single half-cut, an interrupted cut, a score line, an interrupted score line, a line of perforations, a line of short cuts, a line of short slits, a line of short half cuts, and any combination of the aforementioned options.

It should be understood that hinged connection, fold lines and severance lines can each includes elements that are formed in the blank or substrate of sheet material, including perforations, a line of perforations, a line of short slits, a line of half-cuts, a single half-cut, a cut line, an interrupted cut line, slits, scores, any combination thereof, and the like. The elements can be dimensioned and arranged to provide the desired functionality. For example, a line of perforations can be dimensioned or designed with degrees of weakness to define a fold line and/or a severance line. The line of perforations can be designed to facilitate folding and resist breaking, to facilitate folding and facilitate breaking with more effort, or to facilitate breaking with little effort.

The phrase "in registry with" as used herein refers to alignment of two or more elements in an erected carton, such as an aperture formed in a first of two overlapping panels and a second aperture formed in a second of two overlapping panels. Those elements in registry with each other may be aligned with each other in the direction of the thickness of the overlapping panels. For example, when an aperture in a first panel is "in registry with" a second aperture in a second panel that is placed in an overlapping arrangement with the first panel, an edge of the aperture may extend along at least a portion of an edge of the second aperture and may be aligned, in the direction of the thickness of the first and second panels, with the second aperture.

As used herein the term "cutaway" refers to all manner of shapings, recesses, apertures, cuts, slots, holes and gaps which may be circular, rectangular, capsule shaped, irregular shaped and many other shapes that are pre-formed or pre-defined.

The invention claimed is:

1. A carton comprising:

a top wall;

a bottom wall;

a first wall extending between the top wall and the bottom wall;

a second wall extending between the top wall and the bottom wall;

a curved wall joining the first wall and the second wall, a first buttress structure located at a joint between the top wall and one of the first wall and the second wall; the first buttress structure having a curved edge in supporting contact with an inner surface of the curved wall.

2. The carton of claim 1, wherein the curved edge is located apart from the top wall.

3. The carton of claim 2, wherein the curved edge is located at distance below the top wall of at least 10% the height of the carton.

4. The carton of claim 1, further comprising a second curved wall.

5. The carton of claim 4, wherein the second curved wall is supported by a second curved edge of the first buttress structure.

6. The carton of claim 4, wherein the second curved wall is supported by a second buttress structure.

7. The carton of claim 6, wherein the second buttress structure is located diagonally across the top wall from the first buttress structure.

8. The carton of claim 7, further comprising a handle strap formed in the top wall.

9. The carton of claim 8, wherein the top wall comprises two plies of material.

10. The carton of claim 8, wherein the handle comprises two plies of material.

11. The carton of claim 8, further comprising a plurality of containers within the carton.

12. The carton of claim 11, wherein the plurality of containers are bottles with a lower portion having a first diameter and an upper neck having a second diameter less than the first diameter.

13. The carton of claim 12, wherein at least one of the curved walls closely follows the lower portion of at least one bottle.

14. The carton of claim 12, wherein at least one buttress structure extends substantially between at least one of the first wall and the second wall and at least one bottle neck.

15. The carton of claim 12, wherein at least one buttress structure has an inner wall in contact with at least one bottle neck.

16. A carton, comprising:

a top panel having a first curved corner;

a bottom panel having a second curved corner;

a plurality of buttress panels attached to an edge of the top panel, at least one of the plurality of buttress panels having a first curved edge;

each of the first curved corner, the second curved corner, and the first curved edge aligned with one another.

17. The carton of claim 16, wherein the top panel comprises a third curved corner, the bottom panel comprises a fourth curved corner, and a second plurality of buttress panels is attached to an edge of the top panel, at least one of the second plurality of buttress panels having a second curved edge; wherein each of the third curved corner, the fourth curved corner, and the second curved edge are aligned with one another.

18. A blank for forming a carton, the blank comprising a top panel having a first curved corner;

a bottom panel having a second curved corner;

a plurality of buttress panels attached to an edge of the top panel, at least one of the plurality of buttress panels having a first curved edge;

each of the first curved corner and the second curved corner aligned with one another in the blank, and each of the first curved corner, the second curved corner, and the first curved edge aligned with one another when the blank is assembled into the carton.

19. The blank of claim 18, wherein the top panel comprises a third curved corner, the bottom panel comprises a fourth curved corner, and a second plurality of buttress panels is attached to an edge of the top panel, at least one of the second plurality of buttress panels having a second curved edge; wherein each of the third curved corner and the fourth curved corner are aligned with one another in the blank, and each of the third curved corner, the fourth curved corner, and the second curved edge aligned with one another when the blank is assembled into the carton.

20. The blank of claim 19, wherein the first plurality of buttress panels and the second plurality of buttress panels are diagonally opposed across the top panel, and the first plurality of buttress panels and the second plurality of buttress panels are longitudinally offset from one another.

* * * * *